US012358705B2

(12) United States Patent
Zacherle et al.

(10) Patent No.: US 12,358,705 B2
(45) Date of Patent: Jul. 15, 2025

(54) ARTICLE TOP ENGAGING DEVICE, ARTICLE CARRIER AND BLANK THEREFOR

(71) Applicant: WestRock Packaging Systems, LLC, Atlanta, GA (US)

(72) Inventors: Matthew E. Zacherle, Moseley, VA (US); Alex N. Barrette, Richmond, VA (US); Cullen B. Rosenbrien, Richmond, VA (US); Tsugihiko Suzuki, Henrico, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 28 days.

(21) Appl. No.: 17/602,990

(22) PCT Filed: Apr. 10, 2020

(86) PCT No.: PCT/US2020/027571

§ 371 (c)(1),
(2) Date: Oct. 11, 2021

(87) PCT Pub. No.: WO2020/210562

PCT Pub. Date: Oct. 15, 2020

(65) Prior Publication Data

US 2022/0185562 A1 Jun. 16, 2022

Related U.S. Application Data

(60) Provisional application No. 62/832,389, filed on Apr. 11, 2019, provisional application No. 62/885,427,
(Continued)

(51) Int. Cl.
*B65D 71/42* (2006.01)

(52) U.S. Cl.
CPC ..... *B65D 71/42* (2013.01)

(58) Field of Classification Search
CPC ..... B65D 71/40; B65D 71/42; B65D 71/44; B65D 71/50
(Continued)

(56) References Cited

U.S. PATENT DOCUMENTS 4,911,290 A * 3/1990 Karabedian ..... B65D 71/50 206/161
5,065,862 A * 11/1991 Mousseau ..... B65B 17/025 206/150
(Continued)

FOREIGN PATENT DOCUMENTS

CL 2008-002438 A1 5/2009
EP 0771292 A1 5/1997
(Continued)

OTHER PUBLICATIONS

Japanese Office Action dated Nov. 27, 2023, issued during the prosecution of Japanese Patent Application No. 2021/560230.
(Continued)

*Primary Examiner* — Bryon P Gehman
(74) *Attorney, Agent, or Firm* — Brian J. Goldberg; Rohini K. Garg; Tsugihiko Suzuki

(57) ABSTRACT

Aspects of the disclosure relate to an article top engaging device, a carrier for packaging one or more articles and a blank for forming the carrier. The article top engaging device comprises an engaging panel (12; 112; 212; 312; 412; 512; 612; 712) having at least one top-receiving opening (A1, A2, A3, A4, A5, A6, A7, A8) defined by a perimeter which defines a notional circle (NC). The perimeter is interrupted by at least three relief elements (C1, C2, C3, C4, C5, C6, C7, C8, C9, C10, C11) each extending radially away of the center of the notional circle. The perimeter comprises a toothed segment (S1) and a toothless segment (S2). The toothed segment comprises at least two tooth edges (31, 32,
(Continued)

33, 34, 35, 36; 231, 232, 233, 234, 235, 236) for bearing a substantially vertical load.

20 Claims, 15 Drawing Sheets

Related U.S. Application Data filed on Aug. 12, 2019, provisional application No. 62/885,967, filed on Aug. 13, 2019.

(58) Field of Classification Search
USPC ..... 206/147, 148, 150, 151, 161; 294/87.2
See application file for complete search history.

(56) References Cited

U.S. PATENT DOCUMENTS 5,323,895 A * 6/1994 Sutherland ..... B65D 71/40 206/161
5,441,147 A * 8/1995 Tanner ..... B65D 71/504 294/87.2
5,443,153 A 8/1995 Sutherland
5,538,133 A * 7/1996 Campbell ..... B65D 71/42 206/427
5,573,111 A * 11/1996 Gordon ..... B65D 71/42 206/151
5,735,562 A * 4/1998 Borg ..... B65D 71/50 294/87.2
2004/0007480 A1* 1/2004 Pattee ..... B65D 73/0042 206/199
2004/0046406 A1 3/2004 Borg
2018/0362234 A1* 12/2018 L'Heureux ..... B65D 71/504

FOREIGN PATENT DOCUMENTS

GB 2475622 A 5/2011
JP S57-001061 A 1/1982
JP H0343365 A 2/1991
JP 6091210 B2 3/2017
TW 281661 B 7/1996
WO 2011125782 A1 10/2011

OTHER PUBLICATIONS

Chilean Office Action dated Apr. 26, 2023, issued during the prosecution of Chilean Patent Application No. 2021-02671.
Taiwan Office Action dated Dec. 15, 2023, issued during the prosecution of Tawan Patent Application No. 109112180.
Japanese Office Action issued during the prosecution of Japanese Patent Application No. JP 2021-560230.
PCT International Search Report issued during the prosecution of PCT Publication No. WO 2020-210562.

* cited by examiner

ARTICLE TOP ENGAGING DEVICE, ARTICLE CARRIER AND BLANK THEREFOR

TECHNICAL FIELD

The present invention relates to article top engaging devices, article carriers and to blanks for forming the same. More specifically, but not exclusively, the invention relates to a carrier of the top-gripping type having one or more apertures for receiving and retaining an article therein.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide top gripping article carriers in which an aperture is formed in a panel of the carrier, wherein tabs are struck from said aperture. The tabs are displaced out of the plane of said panel when an article is received in the aperture, wherein said tabs engage the article generally about a flange or lip of the article.

The present invention seeks to provide an improvement in the field of cartons, typically formed from paperboard or the like.

SUMMARY

A first aspect of the invention provides an article top engaging device for an article carrier. The article top engaging device comprises an engaging panel having at least one top-receiving opening defined by a perimeter which defines a notional circle. The perimeter is interrupted by at least three relief elements each extending radially away from the center of the notional circle. The perimeter comprises a toothed segment and a toothless segment. The toothed segment comprises at least two tooth edges for bearing a substantially vertical load. Each of the at least two tooth edges is defined between two adjacent ones of the at least three relief elements. The two adjacent relief elements of each tooth edge are tangentially contacted by a first notional tangential line which passes through respective tangential contacting points on respective outer ends of the two adjacent relief elements. The first notional tangential line is spaced apart from the notional circle. The toothless segment comprises at least one continuous supporting edge for bearing a substantially vertical load. The at least one continuous supporting edge is defined between two adjacent ones of the at least three relief elements. The two adjacent relief elements of the at least one continuous supporting edge are tangentially contacted by a second notional tangential line which passes through respective tangential contacting points on the two adjacent relief elements of the at least one continuous supporting edge. The second notional tangential line contacts or intersects with the notional circle.

Optionally, each relief element comprises at least one feature selected from the group consisting of a notch, a recess, a slit, a cut, or a combination of a cut and a tear stopper at the outer end of the cut.

Optionally, a first relief element defining or partially defining the continuous supporting edge may be of a different dimension to a second relief element defining or partially defining a tooth edge.

Optionally, a first relief element defining at least in part the continuous supporting edge may be of a different dimension to a second relief element defining at least in part a tooth edge.

Optionally, the dimension is a width dimension.

Optionally, the dimension is a radial length dimension.

Optionally, the dimension is an angular dimension.

Optionally, each relief element defines first angle having a vertex at a center of the notional circle and the supporting edge defines second angle having a vertex at the center of the notional circle, the first angle is substantially less than the second angle.

Optionally, each relief element comprises a first length and the supporting edge defines second length, the first length is substantially less than the second length.

Optionally, the first length is defined by a first arc of the notional circle defined between outer edges of the relief element and the second length is defined by a second arc of the notional circle defined between adjacent edges of a pair of relief elements defining the supporting edge.

Optionally, the tooth edge comprises third length and the first length is less than the third length.

Optionally, the first length is defined by a first arc of the notional circle defined between outer edges of the relief element and the third length is defined by a third arc of the notional circle defined between adjacent edges of a pair of relief elements defining the tooth edge.

Optionally, the first length is defined by an arc of the notional circle and the third length is defined by the length of a chord of the notional circle which chord is defined between adjacent edges of a pair of relief elements defining the tooth edge.

Optionally, the toothless segment comprises a deformation line at least partially surrounding the perimeter of the at least one top-receiving opening.

Optionally, the toothless segment comprises a fold line at least partially surrounding the perimeter of the at least one top-receiving opening.

Optionally, the toothed segment comprises a fold line extending radially from each of the at least three relief elements.

Optionally, a fold line extends radially from said at least three relief elements to a free edge of the engaging panel.

Optionally, the toothless segment comprises two continuous supporting edges.

Optionally, the toothless segment comprises three continuous supporting edges.

A second aspect of the invention provides an article carrier comprising for packaging at least one article, the article carrier comprising a top panel including at least one a top engaging device having at least one top-receiving opening defined by a perimeter which defines a notional circle, the perimeter being interrupted by at least three relief elements each extending radially away from the center of the notional circle, the perimeter comprising a toothed segment and a toothless segment, the toothed segment comprising at least two tooth edges for bearing a substantially vertical load, each of the at least two tooth edges being defined between two adjacent ones of the at least three relief elements, the two adjacent relief elements of each tooth edge being tangentially contacted by a first notional tangential line which passes through respective tangential contacting points on respective outer ends of the two adjacent relief elements, the first notional tangential line being spaced apart from the notional circle, the toothless segment comprising at least one continuous supporting edge for bearing a substantially vertical load, the at least one continuous supporting edge being defined between two adjacent ones of the at least three relief elements, the two adjacent relief elements of the at least one continuous supporting edge being tangentially contacted by a second notional tangential line which passes through respective tangential contacting points on the two adjacent relief elements of the at least one continuous supporting edge, the second notional tangential line contacting or intersecting with the notional circle.

Optionally, the article carrier comprises a pair of opposed side walls hinged to the top panel by a hinged connection.

Optionally, the hinged connection is interrupted by a separation feature.

Optionally, the article carrier comprises a pair of opposed end walls coupled to the top panel.

A third aspect of the invention provides a blank for forming an article carrier, the blank comprising a main panel including at least one a top engaging device having at least one top-receiving opening defined by a perimeter which defines a notional circle, the perimeter being interrupted by at least three relief elements each extending radially away from the center of the notional circle, the perimeter comprising a toothed segment and a toothless segment, the toothed segment comprising at least two tooth edges for bearing a substantially vertical load, each of the at least two tooth edges being defined between two adjacent ones of the at least three relief elements, the two adjacent relief elements of each tooth edge being tangentially contacted by a first notional tangential line which passes through respective tangential contacting points on respective outer ends of the two adjacent relief elements, the first notional tangential line being spaced apart from the notional circle, the toothless segment comprising at least one continuous supporting edge for bearing a substantially vertical load, the at least one continuous supporting edge being defined between two adjacent ones of the at least three relief elements, the two adjacent relief elements of the at least one continuous supporting edge being tangentially contacted by a second notional tangential line which passes through respective tangential contacting points on the two adjacent relief elements of the at least one continuous supporting edge, the second notional tangential line contacting or intersecting with the notional circle.

A fourth aspect of the invention provides an article engaging device comprising an engaging panel having at least one top-receiving opening defined by a perimeter which defines a notional circle. The perimeter is interrupted by at least two relief elements each extending radially away from the center of the notional circle. The perimeter comprises at least two continuous supporting edges for bearing a substantially vertical load. Each of the at least two continuous supporting edges is defined between two adjacent ones of the at least two relief elements. The two adjacent relief elements of the continuous supporting edge are tangentially contacted by a notional tangential line which passes through respective tangential contacting points on the two adjacent relief elements of each continuous supporting edge. The notional tangential line contacts or intersects with the notional circle.

A fifth aspect of the invention provides an article carrier comprising for packaging at least one article. The article carrier comprises a top panel including at least one a top engaging device having at least one top-receiving opening defined by a perimeter which defines a notional circle. The perimeter is interrupted by at least two relief elements each extending radially away from the center of the notional circle. The perimeter comprises at least two continuous supporting edges for bearing a substantially vertical load. Each of the at least two continuous supporting edges is defined between two adjacent ones of the at least two relief elements. The two adjacent relief elements of the continuous supporting edge are tangentially contacted by a notional tangential line which passes through respective tangential contacting points on the two adjacent relief elements of each continuous supporting edge. The notional tangential line contacts or intersects with the notional circle.

A sixth aspect of the invention provides a blank for forming an article carrier. The blank comprises a main panel including at least one a top engaging device having at least one top-receiving opening defined by a perimeter which defines a notional circle. The perimeter is interrupted by at least two relief elements each extending radially away from the center of the notional circle. The perimeter comprises at least two continuous supporting edges for bearing a substantially vertical load. Each of the at least two continuous supporting edges is defined between two adjacent ones of the at least two relief elements. The two adjacent relief elements of the continuous supporting edge are tangentially contacted by a notional tangential line which passes through respective tangential contacting points on the two adjacent relief elements of each continuous supporting edge. The notional tangential line contacts or intersects with the notional circle.

A seventh aspect of the invention provides an article top engaging device comprising an engaging panel and a facing panel hingedly connected directly to the engaging panel along a fold line. The engaging panel has at least one top-receiving opening adjacent to the facing panel. The opening is defined by a perimeter which defines a notional circle. The perimeter is interrupted by at least three relief elements each extending radially away from the center of the notional circle generally toward the facing panel such that the perimeter comprising at least two engaging teeth for engaging a top of an article. The device further comprises a separation feature disposed between the facing panel and the teeth of the at least one opening.

An eighth aspect of the invention provides an article carrier comprising for packaging at least one article. The article carrier comprising a top panel and at least one side panel hingedly connected thereto. The top panel includes an article top engaging device comprising an engaging panel and a facing panel hingedly connected directly to the engaging panel along a fold line. The engaging panel has at least one top-receiving opening adjacent to the facing panel. The opening is defined by a perimeter which defines a notional circle. The perimeter is interrupted by at least three relief elements each extending radially away from the center of the notional circle generally toward the facing panel such that the perimeter comprising at least two engaging teeth for engaging a top of an article. The device further comprises a separation feature disposed between the facing panel and the teeth of the at least one opening.

A ninth aspect of the invention provides a blank for forming an article carrier. The blank comprises a main panel and at least one side panel. The main panel includes an article top engaging device comprising an engaging panel and a facing panel hingedly connected directly to the engaging panel along a fold line. The engaging panel has at least one top-receiving opening adjacent to the facing panel. The opening is defined by a perimeter which defines a notional circle. The perimeter is interrupted by at least three relief elements each extending radially away from the center of the notional circle generally toward the facing panel such that the perimeter comprising at least two engaging teeth for engaging a top of an article. The device further comprises a separation feature disposed between the facing panel and the teeth of the at least one opening.

A tenth aspect of the invention provides a blank for forming an article carrier comprising an engaging aperture having at least one engaging edge. The engaging edge is defined between a pair of adjacent notches and the engaging edge is curved. The bottom of each notch is curved. The radius of curvature ($R_C$) of each notch is considerably less than the radius of curvature ($R_{CT}$) of the engaging edge.

Optionally, the engaging edge is defined by a tooth.

Optionally, the engaging edge is by non-tooth engaging element.

Optionally, the engaging edge is a tooth edge.

Optionally, the engaging edge is a toothless engaging edge.

An eleventh aspect of the invention provides a blank for forming an article carrier comprising an engaging aperture having at least two engaging elements, wherein the at least two engaging elements are spaced apart from each other by a notch and the engaging edge of each engaging element is curved, the bottom of each notch is curved, wherein the radius of curvature ($R_C$) of each notch is considerably less than the radius of curvature ($R_{CT}$) of the engaging edge.

Optionally, the at least two engaging elements comprise at least two teeth.

Optionally, the at least two engaging elements comprise at least two non-tooth engaging elements.

Optionally, the at least two engaging elements comprise at least one teeth and at least one non-tooth engaging element.

Optionally, the radius of curvature ($R_{CT}$) of the engaging edge is greater than a half of the diameter of an article engaged in a setup carrier.

Optionally, the radius of curvature ($R_C$) of each relief element is about 2.38 mm (3/32").

Optionally, the radius of curvature ($R_C$) of each relief element is in the range 1.59 mm (1/16") to 4.76 mm (3/16").

Optionally, the radius of curvature ($R_{CT}$) of the engaging edge is about 50 mm (63/32").

Optionally, the radius of curvature ($R_{CT}$) of the engaging edge is in the range 30 mm (1.181") to 75 mm (189/64").

Optionally, the ratio of the radius of curvature ($R_C$) of the notches to the radius of curvature ($R_{CT}$) of the engaging edge ($R_C/R_{CT}$) is in the range 0.02 to 0.16, ($0.02<R_C/R_{CT}<0.16$).

Optionally, the corner of each engaging element is rounded and wherein the radius of curvature ($R_{TC}$) of the rounded corner may be generally equal to the radius of curvature ($R_C$) of the notch.

A twelfth aspect of the invention provides a blank for forming an article carrier comprising an engaging aperture having at least one notch along its perimeter, the engaging aperture comprising a notional circle concentric with the engaging aperture and being in tangential contact with the at least one notch, wherein the notional circle has a diameter ($2xR_{CR}$) which is equal to or greater than the diameter of the upper can chime and less than the diameter of the can body, and wherein the diameter of the engaging aperture is less than the upper can chime such that when the upper can chime is received in the engaging aperture, a region of blank peripheral to the engaging aperture is displaced upwardly with respect to the remainder of the blank to bring the perimeter of the engaging aperture into engagement with the underside of the upper can chime.

Optionally, the notional circle diameter ($2xR_{CR}$) is generally equal to the diameter of the upper can chime.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and carriers described herein may be embodied in various and alternative forms. The Figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
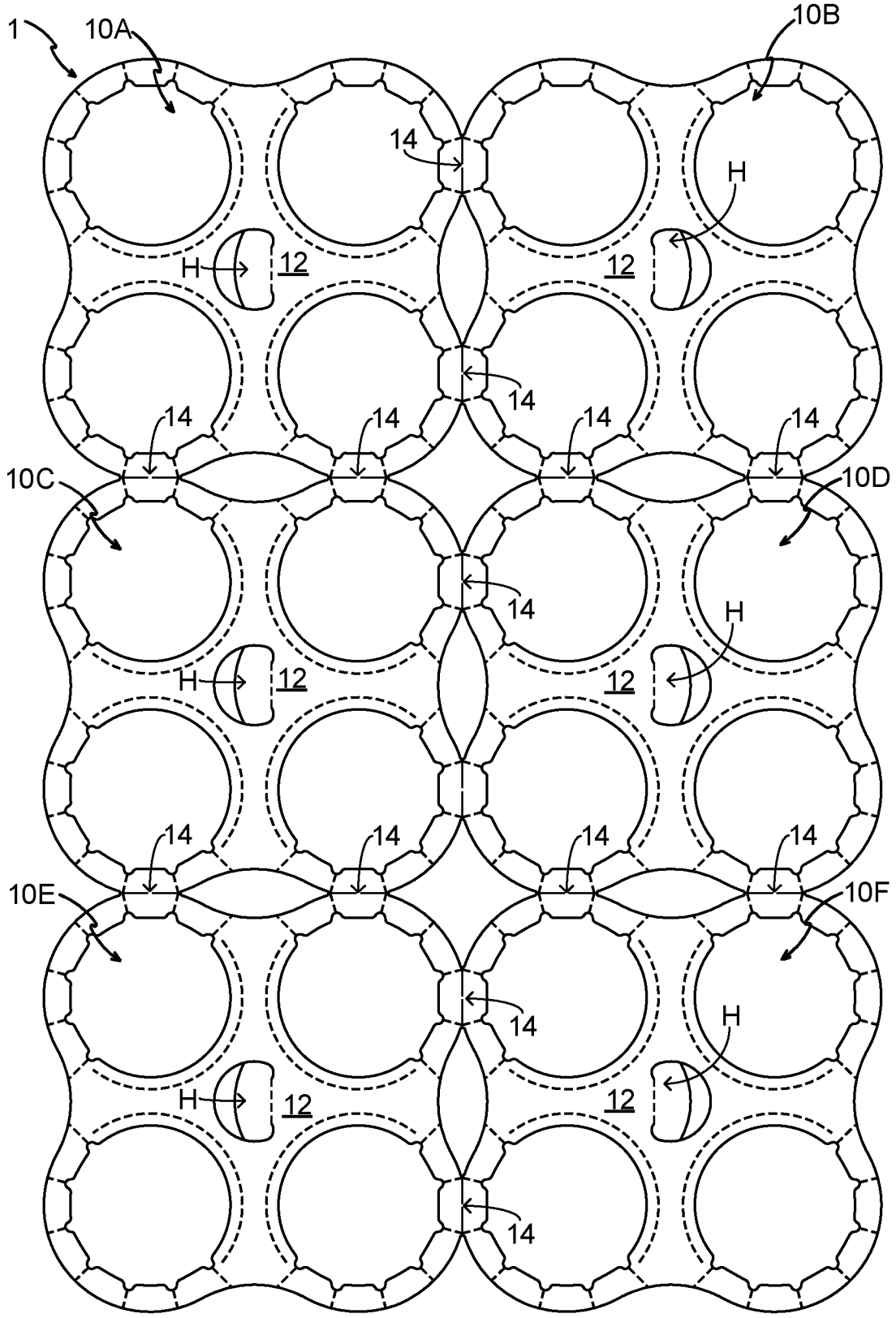
FIG. 1 is a plan view from above of a plurality of connected blanks, each blank capable of forming a carrier according to a first embodiment.
Figure 2:
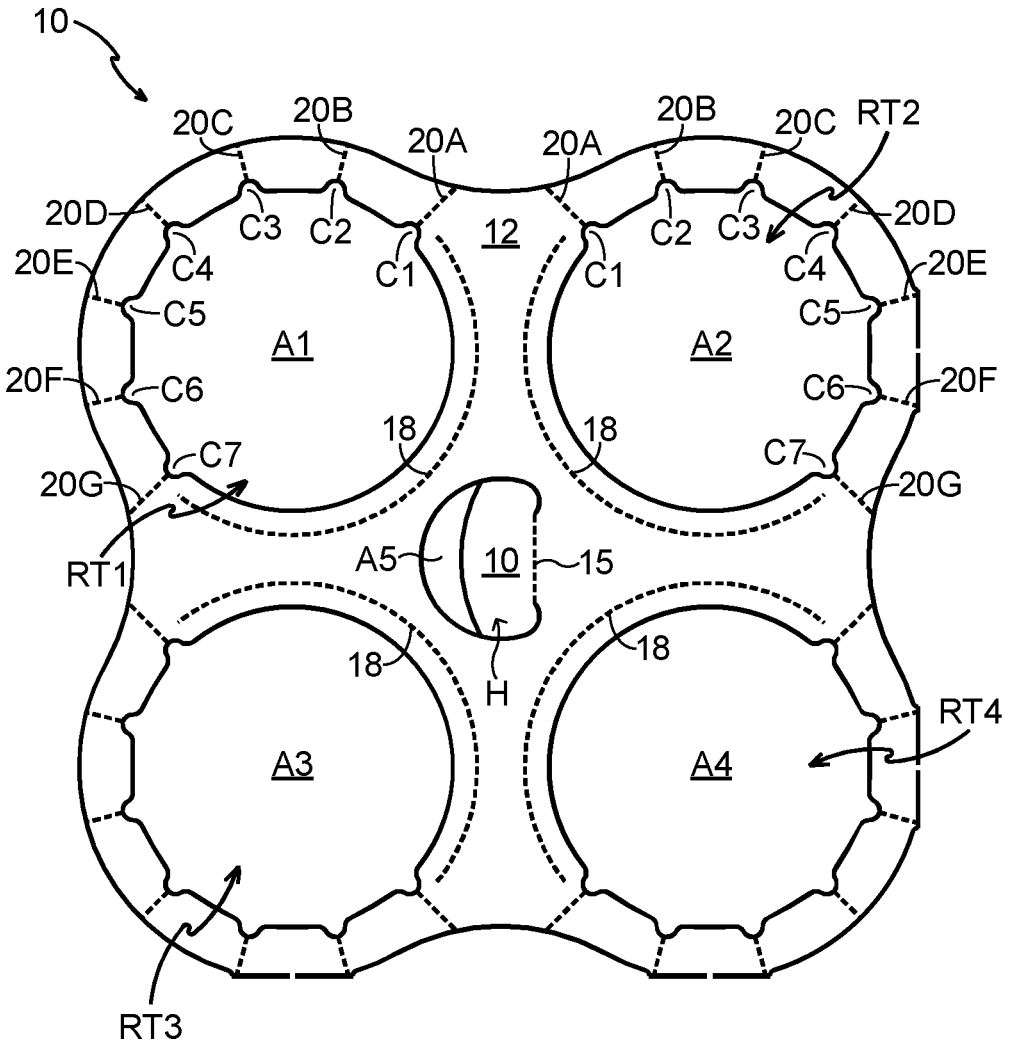
FIG. 2 is a plan view from above of one of the blanks of FIG. 1.
Figure 3:
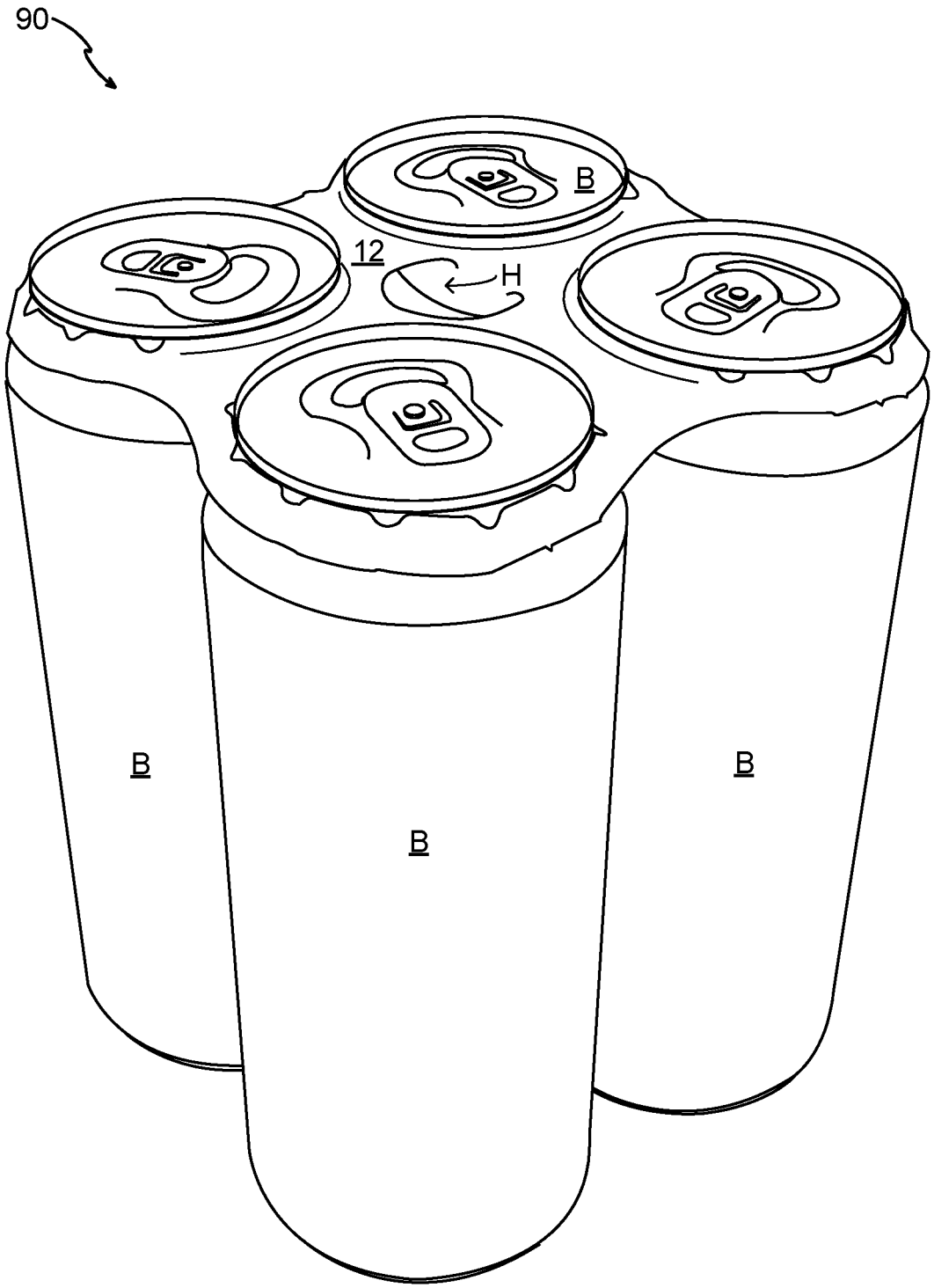
FIG. 3 is a perspective view from above of a carrier formed from the blank of FIG. 2.

Referring to FIG. 1, there is shown a plan view of a plurality of connected blanks 10A, 10B, 10C, 10D, 10D, 10E, 10F; an individual blank 10 is shown in FIG. 2 which is capable of forming a carton or carrier 90, as shown in FIG. 3, for containing and carrying a group of primary products such as, but not limited to, bottles or cans, hereinafter referred to as articles B, as shown in FIG. 3. The blank 10 forms a secondary package for packaging at least one primary product container or package. Alternative blanks 110A, 110B, 110C, 110D, 210A, 210B, 210C, 210D, 310, 410, 510, 610, 710, 810 are shown in FIGS. 4, 5, 6, 7, 9, 10,11 and 12.

In the embodiments detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminum cans), tins, pouches, packets and the like.

The blanks 10, 110A, 110B, 110C, 110D, 210A, 210B, 210C, 210D, 310, 410, 510, 610, 710, 810 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

The packaging structures or cartons described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiments, the blank 10 is configured to form a carton or carrier 90 for packaging an exemplary arrangement of exemplary articles B. In the embodiment illustrated in FIGS. 1, 2 and 3, the arrangement is a 2×2 matrix or array; in the illustrated embodiment two rows of two articles are provided, and the articles B are beverage cans. In the embodiments illustrated in FIGS. 4, 5, 6 and 12, the arrangement is a 3×2 matrix or array; in the illustrated embodiments three rows of two articles are provided, and the articles B are beverage cans. In the embodiments illustrated in FIGS. 7 to 11, the arrangement is a 4×2 matrix or array; in the illustrated embodiments four rows of two articles are provided, and the articles B are beverage cans. Alternatively, the blanks 10, 110A, 110B, 110C, 110D, 210A, 210B, 210C, 210D, 310, 410, 510, 610, 710, 810 can be configured to form a carrier for packaging other types, number and size of articles and/or for packaging articles in a different arrangement or configuration.

Referring to FIG. 1 there is shown a plurality of connected blanks referred to generally by reference sign 1, specifically there are six blanks 10A, 10B, 10C, 10D, 10E, 10F arranged in a 3×2 matrix or array. Each blank 10A, 10B, 10C, 10D, 10E, 10F comprises a main panel 12 for forming a top wall or engaging panel of a carrier 90 (see FIG. 3). Each blank 10A, 10B, 10C, 10D, 10E, 10F is connected to at least two adjacent blanks 10A, 10B, 10C, 10D, 10E, 10F by frangible connections 14.

The main panel 12 includes at least one article retention structure RT1, RT2, RT3, RT4, see FIG. 2. In the embodiment of FIGS. 1 and 2 the main panel 12 comprises a plurality of article retention structures RT1, RT2, RT3, RT4, specifically four article retention structures RT1, RT2, RT3, RT4 arranged in 2×2 matrix or array. Each of the article retention structures RT1, RT2, RT3, RT4 comprise an aperture A1, A2, A3, A4.

Each of the article retention structures RT1, RT2, RT3, RT4 is substantially similar in construction and will therefore be described in detail with reference to the second article retention structure RT2.

The second article retention structure RT2 comprises an article receiving opening defined in part by an aperture A2.

Figure 2B:
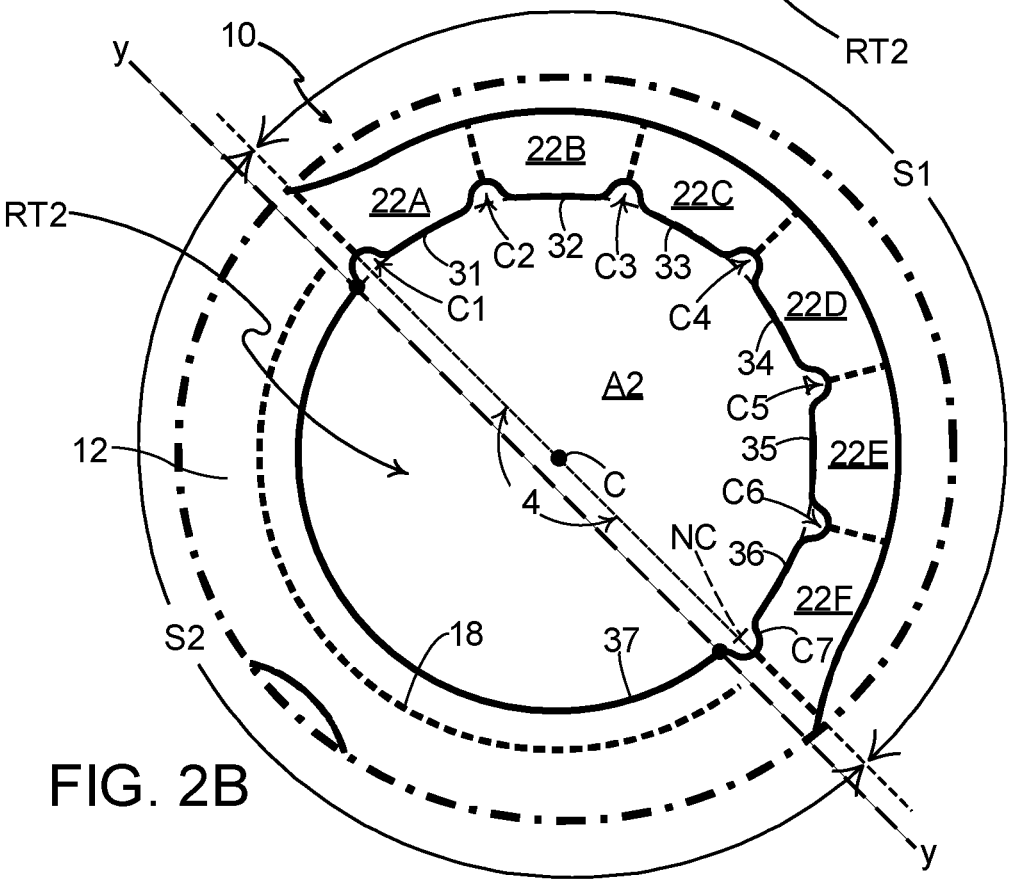
FIG. 2B is an enlarged plan view of a portion of the blank of FIG. 2 showing an article retention structure.

The second article retention structure RT2 comprises a first segment S1 as shown in FIG. 2B and a second segment S2. The first segment S1 defines a first arc and the second segment S2 defines a second arc.

The first segment S1 is 'toothed', the second segment S2 is 'toothless'. That is to say the aperture A2 comprises a plurality of teeth disposed about the first arc, in a perimeter region of the aperture A2 defined by the first segment S1. A perimeter region, second arc, of the aperture A2 defined by the second segment S2 is free from teeth. In the embodiment illustrated in FIG. 2B the second segment S2 defines a continuous arcuate edge.

The 'toothed' region comprises a plurality of teeth 22A, 22B, 22C, 22D, 22E, 22F formed in the main panel 12 about the aperture A2.

Each tooth 22A, 22B, 22C, 22D, 22E, 22F comprises an engaging or tooth edge 31, 32, 33, 34, 35, 36. Each tooth edge 31, 32, 33, 34, 35, 36 may be linear in shape or may be arcuate. The tooth edges 31, 32, 33, 34, 35, 36 may be defined by an arc or portion of a circle. The aperture A2 comprises a perimeter which may approximate, or define, a notional circle NC having a center C.

The 'toothed' region of the main panel 12 surrounding the aperture A2 may comprise cutaways C1, C2, C3, C4, C5, C6, C7 in the form of recesses or notches. The cutaways C1, C2, C3, C4, 5, C6, C7 are substantially "U" shaped, in other embodiments the cutaways C1, C2, C3, C4, C5, C6, C7 may be alternatively shaped such as but not limited to "V" shaped. The cutaways C1, C2, C3, C4, C5, C6, C7 extend radially outward from the notional circle NC.

The teeth 22A, 22B, 22C, 22D, 22E, 22F are each defined, at least in part, by a pair of cutaways C1, C2, C3, C4, C5, C6, C7. The cutaways C1, C2, C3, C4, C5, C6, C7 form relief elements extending radially away from the center of the notional circle NC.

In the embodiment of FIGS. 2 and 2B, the teeth 22A, 22B, 22C, 22D, 22E, 22F are each defined, at least in part, by a pair of fold or score lines 20A, 20B, 20C, 20D, 20E, 20F, 20G.

Each of the fold lines 20A, 20B, 20C, 20D, 20E, 20F, 20G extends from a respective one of the cutaways C1, C2, C3, C4, C5, C6, C7. The fold lines 20A, 20B, 20C, 20D, 20E, 20F, 20G may extend radially outward from said one of the cutaways C1, C2, C3, C4, C5, C6, C7.

The fold lines 20A, 20B, 20C, 20D, 20E, 20F, 20G may extend across the main panel 12 to a free edge of the main panel 12.

The toothless or tooth free region of the main panel 12 surrounding the aperture A2 comprises an engaging or free edge 37 (also referred to herein as continuous supporting edge). The engaging edge 37 is curvilinear or arcuate in shape.

The toothless or tooth free region of the main panel 12 surrounding the aperture A2 may be defined in, or occupy, an arc subtending an angle θ4, the angle θ4 having its vertex at the center C of the notional circle NC. In some embodiments the angle θ4 may be substantially 180°, in other embodiments, the angle θ4 may be less than 180°, for example but not limited to 170°. In other embodiments, the angle θ4 may be more than 180° and less than 360°, for example but not limited to 270°. In further embodiments, an aperture of an article retention structure may have its perimeter consisting of a toothless or tooth free region/segment only. Examples of such apertures will be described with reference to FIGS. 7, 9 and 10.

In this way substantially half of the perimeter of the aperture A2 comprises teeth 22A, 22B, 22C, 22D, 22E, 22F.

The toothless or tooth free region of the main panel 12 surrounding the aperture A2 may comprise a deformation line 18. The deformation line 18 may take the form of a fold or score line. The deformation line 18 is shaped to be similar to the engaging edge 37. In the illustrated embodiment the deformation line 18 is arcuate in shape. The deformation line 18 may be defined by a portion of a circle which is concentric with a circle defining the engaging edge 37 and which is larger in diameter than the circle defining the engaging edge 37.

The deformation line 18 may take the form of a circumferential fold line substantially surrounding the second segment S2.

The second article retention structure RT2 comprises two adjacently disposed relief elements C1, C7 between which the continuous supporting or engaging edge 37 is defined.

The two adjacent relief elements C1, C7 of the continuous supporting edge 37 are tangentially contacted by a notional tangential line y-y. The notional tangential line y-y passes through respective tangential contacting points TP, TP on the two adjacent relief elements C1, C7 of the continuous supporting edge 37. The notional tangential line y-y contacts or intersects with the notional circle NC.

The main panel 12 may optionally comprise a handle structure H. The handle structure H may comprise a first handle aperture A5. The first handle aperture A5 is struck from the main panel 12 and is located in a region disposed centrally between a first pair of article retention structures RT1, RT2 and a second pair of article retention structures RT3, RT4. The first handle aperture A5 may be defined in part by a cushioning tab 16 hinged to the main panel 12 by fold line 15. The first handle aperture A5 may be substantially crescent or "C" shaped.

Optionally, the side edges of the main panel 12 may be arranged in a curvilinear or undulating shape. In this way, a first blank 10 may be arranged in a nested arrangement with a second blank 10. The undulating shape provides that the first and second blanks 10 together define a width which is less than twice the maximum width of an individual blank 10. This may have economic and environmental benefit by reducing the amount of substrate required to produce a given number of blanks 10.

The main panel 12 includes at least a paperboard substrate. The material of the paperboard substrate may be selected from any conventional paperboard, for example, ranging in weight upwardly from about 10 pt., preferably from about 16 pt. to about 28 pt. (0.028"/–0.7 mm). An example of such a substrate is a 28 point (pt.) SBS board (solid bleached sulfate paperboard coated on one side, trade name PrintKote®) or CNK® board (Coated Natural Kraft®—an unbleached kraft paperboard having a clay coating on one side, trade name CarrierKote™) manufactured by WestRock® Company. The paperboard substrate may be a bleached or unbleached board. The board may be coated on at least one side, optionally the side opposite the lamination, with a conventional coating selected for compatibility with the printing method and board composition.

The main panel 12 may include a tear resistant layer laminated to the paperboard layer. It optionally includes an adhesive layer between the paperboard substrate and the tear resistant layer. The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR®, which is a bi-axially oriented polyester, oriented nylon, cross-laminated polyolefin or high density polyolefin. The orientation and cross-laminated structure of these materials contribute to the tear resistant characteristic. Also, tear resistance may be attributed to the chemical nature of the tear resistant material such as extruded metallocene-catalyzed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low-density polyethylene (LDPE). The adhesive layer may be placed between the substrate and the tear resistant layer to secure the tear resistant layer to the substrate.

In one embodiment the main panel 12 is formed from two layers of paperboard substrate. A first layer of paperboard having coating on one side is bonded to a second layer of paperboard having a coating on one side. The uncoated side of the first layer is bonded to the uncoated side of the second layer with an adhesive treatment or glue. In one example a first sheet of a 28 pt CBS or CNK board is bonded to a second sheet a 28 pt CBS or CNK board. This produces a substrate having a thickness of about 0.056" around 1.4 mm having coating on opposing faces thereof. An advantage of such a substrate is increased strength without the inclusion of a polymeric material or plastics material, such substrates may provide environmental benefit and be more easily recycled.

In some embodiments at least one tear resistant layer may be disposed between the first and second layers of the substrate, such a substrate may be formed by bonding two sheets of material at least one of which comprises a tear resistant layer laminated thereto. This may have the advantage of increasing the strength of the substrate.

Turning to the construction of the carrier 90 from the blank 10, the blank 10 may be applied to a group of articles B. The blank 10 is lowered with respect to the group of articles B. Each of the article retention structures RT1, RT2, RT3, RT4 of the blank 10 are aligned with a respective article B in the group. Portions of the articles B pass through the main panel 12. The toothed regions of the main panel 12 about each of the article retention structures RT1, RT2, RT3, RT4 may be folded out of the plane of the main panel 12.

Each toothed region of the main panel 12 may be folded about one of the articles received in the respective one of the article retention structures RT1, RT2, RT3, RT4, the fold lines 20A, 20B, 20C, 20D, 20E, 20F, 20G may facilitate the deformation of the blank 10 about the article B for example but not limited to a shoulder portion of the article, where the article is a can the shoulder portion may be provide by the neck-in.

The engaging edges 31, 32, 33, 34, 35, 36 of the teeth 22A, 22B, 22C, 22D, 22E, 22F and the engaging edge 37 of the tooth free region of the main panel 12 engage beneath a projection. The projection may be located about the neck or chime of the article b (which may provide a flange) of an article B. When the article B is can the projection may be provided by a canner's end seam. In other embodiments it may be provided by a ridge or undercut shaping of the article B or by an end closure of the article B for example but not limited to a crown cork or closure. In this way, the engaging edges 31, 32, 33, 34, 35, 36, 37 grip or hold the article B and prevent or inhibit the article B from unintentionally separating from the main panel 12. The assembled carrier 90 is shown in FIG. 3.

Another optional feature of the carrier 90 is that the main panel 12 is defined by a perimeter to which no other part of the carrier 90 is connected. That is to say, the carrier 90 is free of connection to other panels for example, but not limited to, side or end wall panels which extend about the sides of the article group. The perimeter of the main panel 12 is therefore defined in its entirety by free, cut or unhinged edges.

Another optional feature of the carrier 90 is that the main panel 12 is defined by a perimeter including convexly curved edges and concavely curved edges, wherein the radius of curvature of the convexly curved edges is substantially equal to the radius of curvature of the concavely curved edges, thus allowing two similar blanks 10 to be placed in a nested or tessellated arrangement.

In some embodiments the plurality of blanks 1 is applied simultaneously to a first group of articles B. The first group of articles B is divisible into a plurality of second groups of articles B. Each second group of articles B is thus formed from a subset of the first group of articles B. The embodiment illustrated in FIG. 1 the first group of articles B comprises twenty-four articles arranged in a 4×6 matrix or array, and each individual blank 10A, 10B, 100, 10D, 10E, 10F accommodates four articles in a 2×2 matrix or array.

The frangible connections 14 between the individual blanks 10A, 10B, 100, 10D, 10E, 10F may separate upon application of the plurality of blanks 1 to the first group of articles B. Alternatively, the frangible connections 14 may remain intact, individual blanks 10A, 10B, 100, 10D, 10E, 10F may be separated from the others at a point of sale or distribution.

Referring now to FIGS. 4 to 12, there are shown additional embodiments of the present disclosure. In the second, third, fourth, fifth, sixth, seventh, eighth and ninth illustrated embodiment like numerals have, where possible, been used to denote like parts, albeit with the addition of the prefix "100", "200", "300", "400", "500", "600", "700", "800" to indicate that these features belong to the second, third, fourth, fifth, sixth, seventh and eighth embodiments respectively. The additional embodiments share many common features with the first embodiment and therefore only the differences from the embodiment illustrated in FIGS. 1 to 3 will be described in detail.

Figure 4:
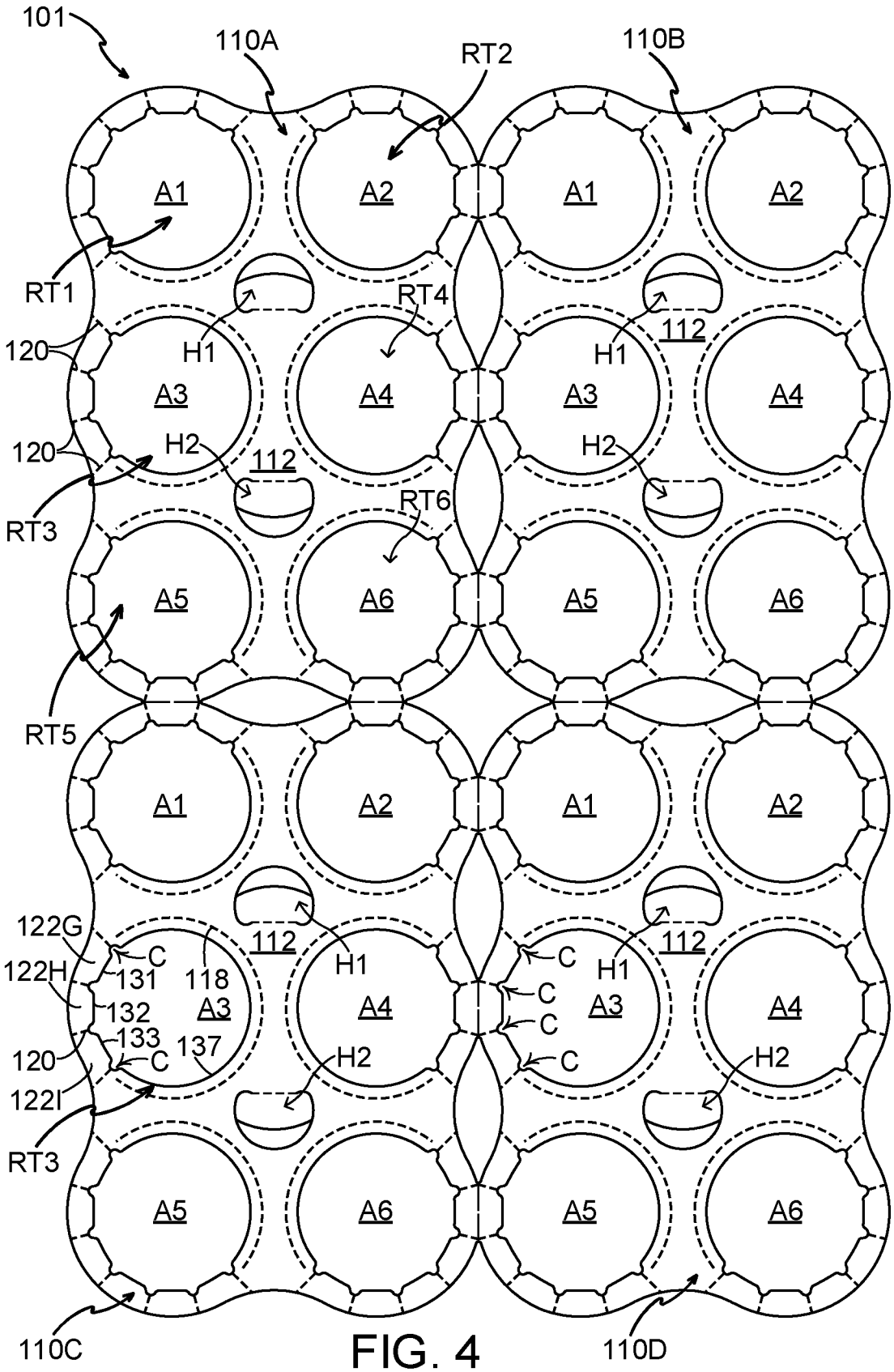
FIG. 4 is a plan view from above of a plurality of connected blanks, each blank capable of forming a carrier according to a second embodiment.

FIG. 4 illustrates a second embodiment and shows a plurality of connected blanks referred to generally by reference sign 101 specifically there are four blanks 110A, 110B, 110C, 110D, arranged in a 2×2 matrix or array. Each blank 110A, 110B, 110C, 110D comprises a main panel 112 for forming a top wall or engaging panel of a carrier (not shown). Each blank 110A, 110B, 110C, 110D is connected to two adjacent blanks 110A, 110B, 110C, 110D, by frangible connections 114.

The main panel 112 of each blank 110A, 110B, 110C, 110D includes at least one article retention structure RT1, RT2, RT3, RT4, RT5, RT6. The main panel 112 comprises a plurality of article retention structures RT1, RT2, RT3, RT4, RT5, RT6, specifically six article retention structures RT1, RT2, RT3, RT4, RT5, RT6 arranged in 3×2 matrix or array. Each of the article retention structures RT1, RT2, RT3, RT4, RT5, RT6 comprise an aperture A1, A2, A3, A4, A5, A6.

Each of the article retention structures RT1, RT2, RT5, RT6, also referred to as endmost article retention structures RT1, RT2, RT5, RT6, is substantially similar in construction to the article retention structures RT1, RT2, RT3, RT4 of the embodiment of FIGS. 1, 2 and 2B. These article retention structures comprise six teeth disposed about the perimeter of the apertures A1, A2, A5, A6. The article retention structures RT1, RT2, RT5, RT6 are disposed in corners or the main panel 112.

The article retention structures RT3, RT4, also referred to as intermediate article retention structures RT3, RT4, are disposed medially on the main panel 112, between a first pair of end most article retention structures RT1, RT2 and a second pair of end most article retention structures RT5, RT6.

The intermediate article retention structures RT3, RT4 comprise three teeth 122G, 122H, 122I each tooth 122G, 122H, 122I is defined in part by a pair of relief elements C. Each tooth 122G, 122H, 122I may be defined in part by a pair of fold lines 120. Each tooth 122G, 122H, 122I comprises an engaging edge 131, 132, 133. The engaging edges 131, 132, 133 of the teeth 122G, 122H, 122I occupy a portion of the perimeter of the aperture A3, A4, the portion defines an arc of a notional circle having a center, the angle subtended by the arc may be less than 120°, it may be greater than 60° and may be around 90°. The retention structures RT3, RT4 comprises a toothless or tooth free portion. The tooth free region comprises a continuous engaging edge which is defined between a pair of adjacent relief elements C. The two adjacent relief elements C of the continuous supporting edge 137 are tangentially contacted by a notional tangential line. The notional tangential line passes through respective tangential contacting points on the two adjacent relief elements C of the continuous supporting edge 137. The notional tangential line contacts or intersects with the notional circle.

The toothless or tooth free region of the main panel 112 surrounding the aperture A3, A4 may comprise a deformation line 118. The deformation line 118 may take the form of a fold or score line. The deformation line 118 is shaped to be similar to the engaging edge 137. The deformation line 118 defines an arc subtending an angle substantially similar to that of the continuous edge 137.

The main panel 112 may optionally comprise a handle structure H1, H2. The handle structure H1, H2 may comprise a first opening formed at least in part by a first handle aperture. The first handle aperture is struck from the main panel 112 and is located in a region disposed centrally between a first pair of article retention structures RT1, RT2 and a second pair of article retention structures RT3, RT4. The first opening may be defined in part by a first cushioning tab hinged to the main panel 112 by a fold line. The first handle aperture may be substantially crescent or "C" shaped. The handle structure H1, H2 may comprise a second opening formed at least in part by a second handle aperture. The second handle aperture is struck from the main panel 112 and is located in a region disposed centrally between the second pair of article retention structures RT3, RT4 and a third pair of article retention structures RT5, RT6. The second opening may be defined in part by a second cushioning tab hinged to the main panel 112 by a fold line. The second handle aperture may be substantially crescent or "C" shaped. The first and second openings may be arranged in opposition to each other, such that the first and second cushioning flaps are hinged to the main panel 112 in opposition to each other.

Figure 5B:
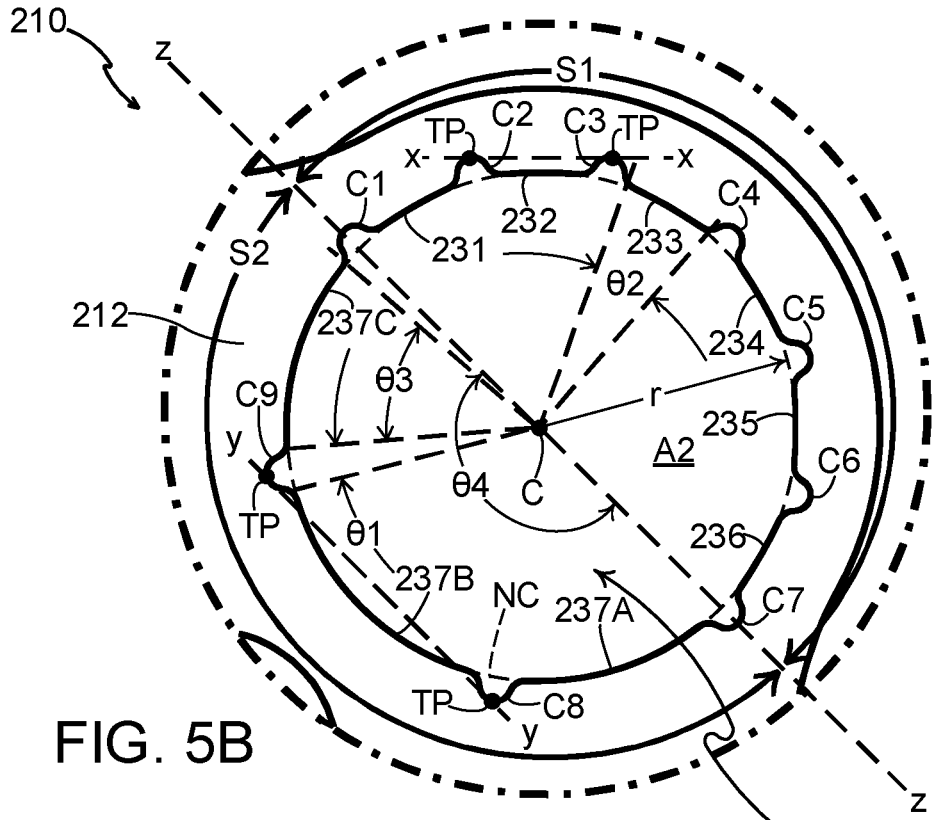
FIG. 5B is an enlarged plan view of a portion of one of the blanks of FIG. 5 showing an article retention structure.
Figure 5:
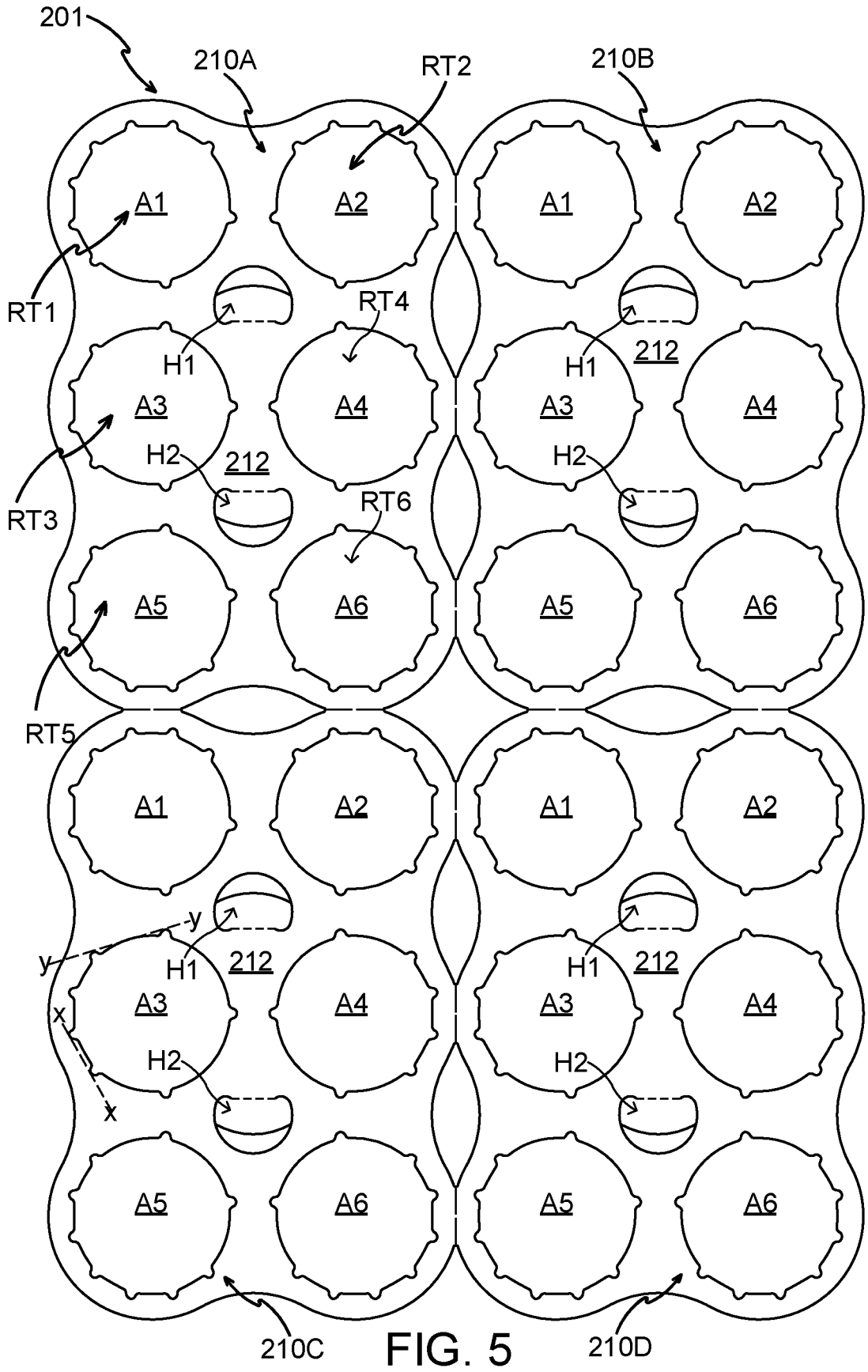
FIG. 5 is a plan view from above of a plurality of connected blanks, each blank capable of forming a carrier according to a third embodiment.

FIG. 5 illustrates a third embodiment and shows a plurality of connected blanks referred to generally by reference sign 201 specifically there are four blanks 210A, 210B, 210C, 210D, arranged in a 2×2 matrix or array. Each blank 210A, 210B, 210C, 210D comprises a main panel 212 for forming a top wall or engaging panel of a carrier (not shown). Each blank 210A, 210B, 210C, 210D is connected to two adjacent blanks 210A, 210B, 210C, 210D, by frangible connections 214.

In the embodiment of FIG. 5, endmost article retention structures RT1, RT2, RT5, RT6 comprise six teeth defined, at least in part, by seven relief elements C1, C2, C3, C4, C5, C6, C7. The endmost article retention structures RT1, RT2, RT5, RT6 each comprises a toothless region providing three continuous supporting edges and two relief elements C8, C9. The toothed segment of each endmost retention structure occupies substantially 180° of the perimeter of the respective aperture A1, A2, A5, A6. The toothless segment of each endmost retention structure occupies substantially 180° of the perimeter of the respective aperture A1, A2, A5, A6.

In the embodiment of FIG. 5, each of medial article retention structures RT3, RT4 comprises three teeth defined, at least in part, by four relief elements. The medial article retention structures RT3, RT4 each comprises a toothless region providing four continuous supporting edges and three relief elements. The toothed segment of each medial retention structure occupies substantially 90° of the perimeter of the respective aperture A3, A4. The toothless segment of each medial retention structure occupies substantially 270° of the perimeter of the respective aperture A3, A4.

An enlarged view of a second article retention structure RT2 is shown in FIG. 5B.

The second article retention structure RT2 comprises an article receiving opening defined in part by an aperture A2.

The second article retention structure RT2 comprises a first segment S1 as shown in FIG. 5B and a second segment S2. The first segment S1 defines a first arc and the second segment S2 defines a second arc.

The first segment S1 is 'toothed', the second segment S2 is 'toothless'. That is to say the aperture A2 comprises a plurality of teeth disposed about the first arc (the main panel 212 comprises a plurality of teeth defining a toothed segment or arc of the aperture A2), in a perimeter region of the aperture A2 defined by the first segment S1. A perimeter region, second arc, of the aperture A2 defined by the second segment S2 is free from teeth. In the embodiment illustrated in FIG. 2B the second segment S2 defines a continuous arcuate edge.

The 'toothed' region comprises a plurality of teeth formed in the main panel 12 about the aperture A2. The illustrated embodiment comprises six teeth.

The aperture A2 comprises a perimeter which may approximate, or define, a notional circle NC having a center C.

The 'toothed' region of the main panel 212 surrounding the aperture A2 comprises cutaways C1, C2, C3, C4, C5, C6, C7 in the form of recesses or notches. The cutaways C1, C2, C3, C4, C5, C6, C7 are substantially "U" shaped, in other embodiments the cutaways C1, C2, C3, C4, C5, C6, C7 may be alternatively shaped such as but not limited to "V" shaped. The cutaways C1, C2, C3, C4, C5, C6, C7 extend radially outward from the notional circle NC.

The cutaways C1, C2, C3, C4, C5, C6, C7 define, at least in part, the teeth of the first segment S1. The teeth are defined between adjacent pairs C1/C2, C2/C3, C3/C4, C4/C5, C5/C6, C6/C7 of the cutaways C1, C2, C3, C4, C5, C6, C7.

The cutaways C1, C2, C3, C4, C5, C6, C7 define or subtend a first angle θ1. The cutaways C1, C2, C3, C4, C5, C6, C7 occupy an arc of the notional circle NC having a first arc length, also referred to as the relief element length. The relief element length is equal to first angle θ1 divided by 360° multiplied by the diameter and by π.

$$\text{relief element length} = \left(\frac{\theta 1}{360}\right)\pi d$$

Each tooth comprises a tooth edge 231, 232, 233, 234, 235, 236.

Each tooth edge 231, 232, 233, 234, 235, 236 may be linear in shape or may be arcuate. The tooth edges 231, 232, 233, 234, 235, 236 may be defined by an arc or portion of a circle.

Each tooth edge 231, 232, 233, 234, 235, 236 may be defined by an arc of the notional circle NC which subtends a second angle θ2, also referred to as the tooth angle. The tooth angle θ2 and the radius r or diameter (d=2r) define the length of the tooth edge 231, 232, 233, 234, 235, 236. The arc length, also referred to herein as tooth edge length, is equal to the tooth angle θ2 divided by 360° multiplied by the diameter and by π.

$$\text{tooth edge length} = \left(\frac{\theta 2}{360}\right)\pi d$$

When the tooth edge 231, 232, 233, 234, 235, 236 is linear the length of the tooth edge 231, 232, 233, 234, 235, 236 may be defined by the length of a chord of the notional circle NC extending between adjacent edges of a pair of relief elements, the length of the tooth edge 231, 232, 233, 234, 235, 236 may be given by twice the radius of the notional circle NC multiplied by the sine of half the tooth angle θ2.

$$\text{tooth edge length} = 2r\sin\left(\frac{\theta 2}{2}\right)$$

Each tooth edge 231, 232, 233, 234, 235, 236 may be defined by an arc of the notional circle NC in which the angle θ2 subtended is sufficiently small that the tooth edge 231, 232, 233, 234, 235, 236 is approximately linear.

Each tooth edge 231, 232, 233, 234, 235, 236 is divergently arranged with respect to it adjacent or neighboring tooth edges 231, 232, 233, 234, 235, 236.

The cutaways C1, C2, C3, C4, C5, C6, C7 form relief elements extending radially away from the center of the notional circle NC.

The toothed segment S1 comprises at least two tooth edges 231, 232, 233, 234, 235, 236 for bearing a substantially vertical load. Each of the at least two tooth edges 231, 232, 233, 234, 235, 236 are defined between two adjacent relief elements. The two adjacent relief elements of each tooth edge 231, 232, 233, 234, 235, 236 are tangentially contacted by a first notional tangential line x-x. The first notional tangential line x-x passes through respective tangential contacting points TP, TP on respective outer ends of the two adjacent relief elements, best shown in FIG. 5B. The first notional tangential line x-x is spaced apart from the notional circle NC and may lie outside the notional circle NC.

The deformation line 18 and fold lines 20A, 20B, 20C, 20D, 20E, 20F, 20G of the first embodiment shown in FIGS. 1 and 2B have been omitted from each of the article retention structures RT1, RT2, RT3, RT4, RT5, RT6.

The toothless or tooth free region/segment S2 of the main panel 212 surrounding the aperture A2 comprises at least one supporting edge 237A, 237B, 237B. The at least one supporting edge 237A, 237B, 237B may be curvilinear or arcuate in shape. The second article retention structure RT2 comprises two relief elements C1, C7, each of which defines an end of a tooth, between which the toothless region/segment S2, S2 is defined.

The toothless or tooth free region/segment of the main panel 212 surrounding the aperture A2 may be defined in, or occupy, an arc subtending an angle θ4, the angle θ4 having its vertex at the center C of the notional circle NC. In some embodiments, the angle θ4 may be substantially 180°. In other embodiments, the angle θ4 may be less than 180°, for example but not limited to 170°. In other embodiments, the angle θ4 may be more than 180°, for example but not limited to 270.

In this way substantially half of the perimeter of the aperture A2 comprises teeth.

The toothless or tooth free region/segment of the main panel 12 surrounding the aperture A2 may comprise at least one relief element C8, C9 in the form of recess notched out of the perimeter of the aperture A2. The segment of the perimeter of the aperture A2 provides at least two continuous supporting edges 237A, 237B, 237C each of which is curvilinear or arcuate in shape. The supporting edges 237A, 237B, 237C each comprises an arc length defined between a pair of relief elements C1/C9, C8/C9, C7/C8. The arc length of each supporting edge 237A, 237B, 237C is given by the angle between them and the radius r of the notional circle NC, for example supporting edge 237C has an arc length given by:

$$\text{supporting edge portion length} = \left(\frac{\theta 3}{360}\right)\pi d$$

Each of the supporting edges 237A, 237B, 237C comprise a length which is substantially greater than the length of the relief elements C8, C9 or cutaways C1, C2, C3, C4, C5, C6, C7. In other words, the relief elements C8, C9 or cutaways C1, C2, C3, C4, C5, C6, C7 each occupies an angle θ1 which is substantially smaller or less than the angle θ3 occupied by each supporting edge 237A, 237B, 237C. The angle θ3 occupied by each supporting edge 237A, 237B, 237C is substantially greater than the angle θ2 occupied by each of the tooth edges 231, 232, 233, 234, 235, 236. In some embodiments, the angle θ3 may be at least twice as great as the angle θ2.

Each tooth edge 231, 232, 233, 234, 235, 236 may comprise a length which is greater than the length of each of the relief elements C8, C9 or cutaways C1, C2, C3, C4, C5, C6, C7. In other words, the relief elements C8, C9 or cutaways C1, C2, C3, C4, C5, C6, C7 each occupies an angle θ1 which is smaller or less than the angle θ2 occupied by each of the tooth edges 231, 232, 233, 234, 235, 236.

Referring to FIG. 5, a first relief elements C8 is disposed adjacent to a second relief element C9. The two adjacent relief elements C8, C9 of each continuous supporting edge 237A, 237B, 237B are tangentially contacted by a second notional tangential line y-y. The second notional tangential line y-y passes through respective tangential contacting points TP, TP on the two adjacent relief elements C8, C9 of the continuous supporting edge 237B. The notional tangential line y-y contacts or intersects with the notional circle NC.

Figure 6:
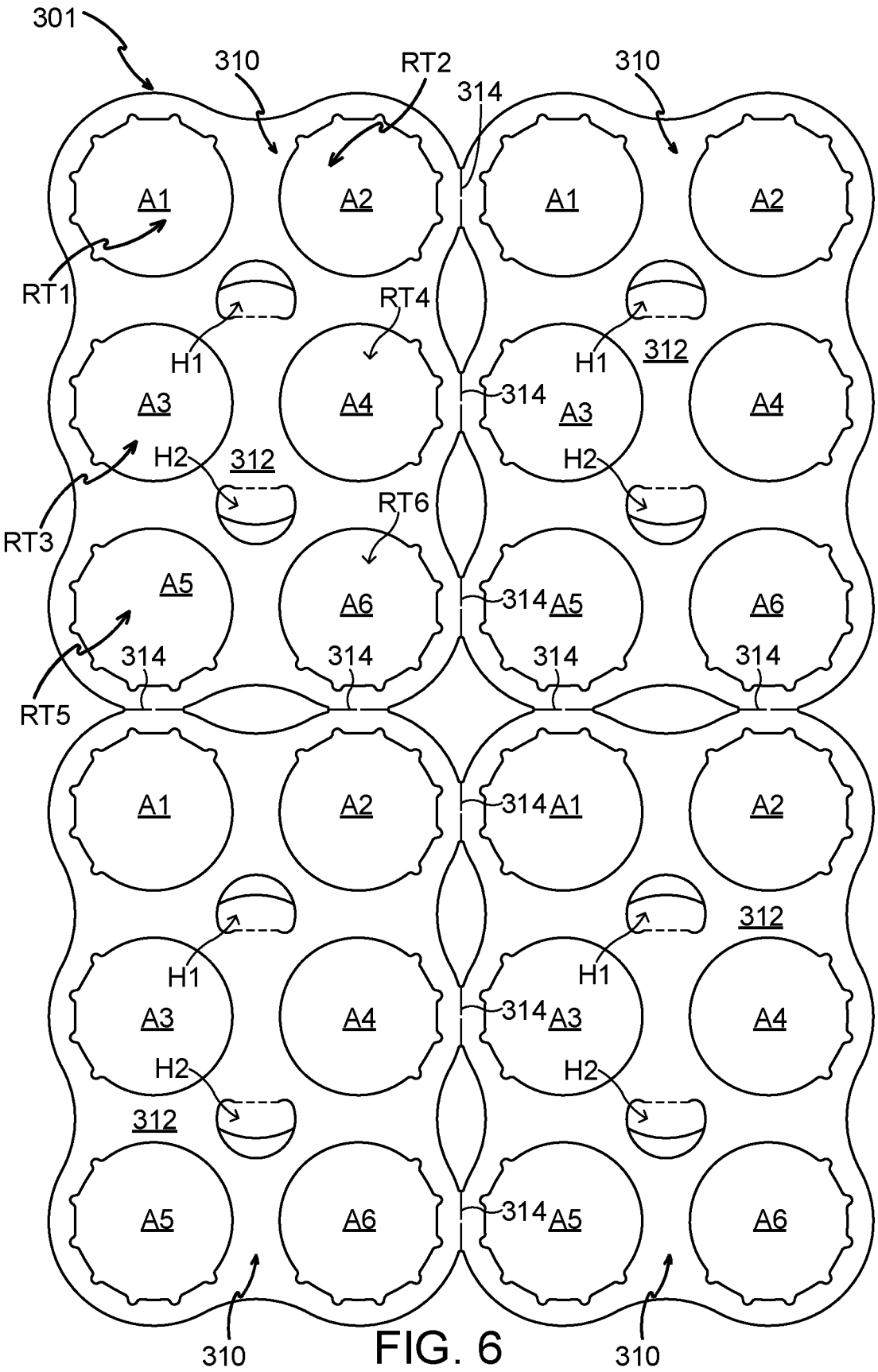
FIG. 6 is a plan view from above of a plurality of connected blanks, each blank capable of forming a carrier according to a fourth embodiment.

FIG. 6 illustrates a fourth embodiment and shows a plurality of connected blanks referred to generally by reference sign 301 specifically there are four blanks 310A, 310B, 310C, 310D, arranged in a 2×2 matrix or array. Each blank 310A, 310B, 310C, 310D comprises a main panel 312 for forming a top wall or engaging panel of a carrier (not shown). Each blank 310A, 310B, 310C, 310D is connected to two adjacent blanks 310A, 310B, 310C, 310D, by frangible connections 314.

Each of the blanks 310A, 310B, 310C, 310D are substantially similar in structure to the blank 10 of FIG. 2 albeit the deformation line 18 has been omitted from each of the article retention structures RT1, RT2, RT3, RT4, RT5, RT6.

Figure 7:
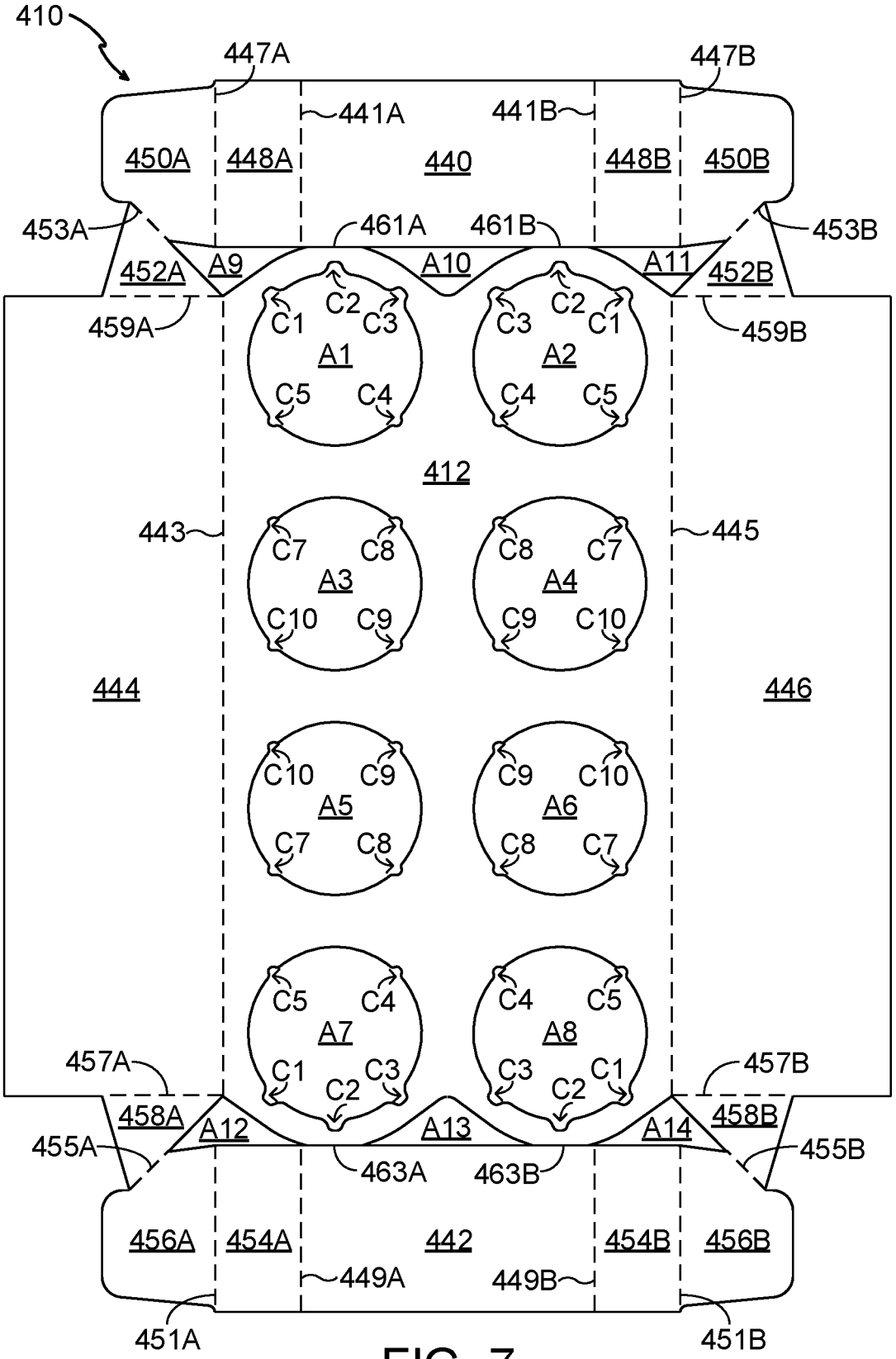
FIG. 7 is a plan view from above of a plurality of connected blanks, each blank capable of forming a carrier according to a fifth embodiment.
Figure 8:
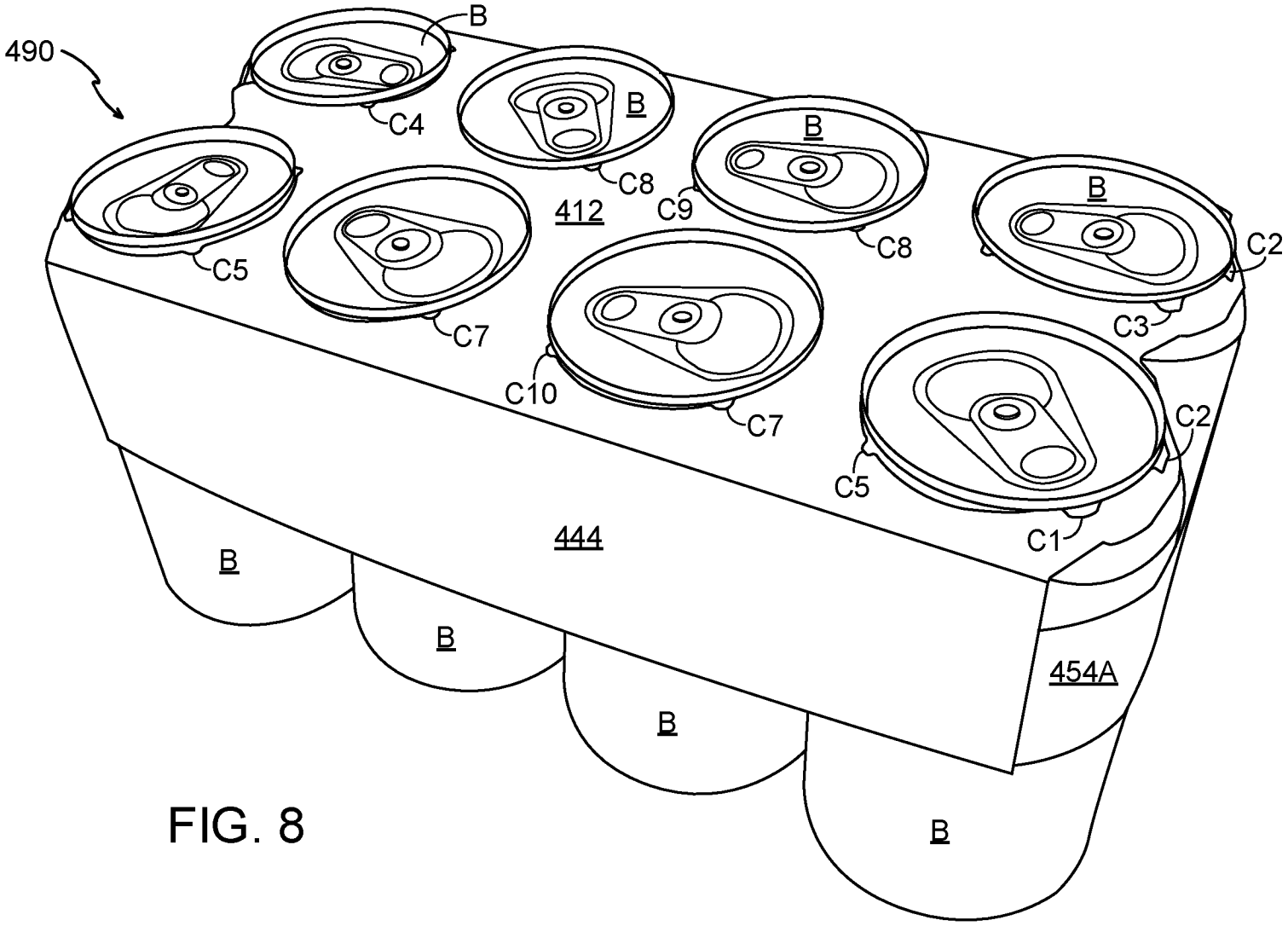
FIG. 8 is a perspective view from above of a carrier formed from the blank of FIG. 7.

FIG. 7 illustrates a fourth embodiment and shows a blank 410 for forming a carrier 490 shown in FIG. 8. The carrier takes the form of a top-gripping clip or carrier. The blank 410 comprises a main panel 412 forming a top panel of the carrier.

A first side panel 444 is hingedly connected to a first side of the main panel 412 by a hinged connection in the form of a fold line 443. A second side panel 446 is hingedly connected to a second side of the main panel 412 by a hinged connection in the form of a fold line 445.

The blank comprises a first end strap 450A/448a/440/448B/450B. The first end strap 450A/448a/440/448B/450B comprises a first end panel 440. A first corner panel 448A is hingedly connected to a first end of the first end panel 440 by a hinged connection in the form of a fold line 441A. A first securing panel 450A is hingedly connected to an end of the first corner panel 448A by a hinged connection in the form of a fold line 447A. A first gusset panel 452A is hingedly interconnected between the first securing panel 450A and a first end of the first side panel 444 by fold lines 453A, 459A.

A second corner panel 448B is hingedly connected to a second end of the first end panel 440 by a hinged connection in the form of a fold line 441B. A second securing panel 450B is hingedly connected to an end of the second corner panel 448B by a hinged connection in the form of a fold line 447B. A second gusset panel 452B is hingedly interconnected between the second securing panel 450B and a first end of the second side panel 446 by fold lines 453B, 459B.

The first end panel 440 is separated from, or severable from, the main panel 412. The blank 410 may comprise an aperture A10 separating at least a portion of the first end panel 440 from the main panel 412. The blank 410 may comprise at least one cut line or frangible line 461A, 461B severing the first end panel 440 from the main panel 412.

The first corner panel 448A is separated from the main panel 412. The blank 410 comprises an aperture A9 separating the first corner panel 448A from the main panel 412.

The second corner panel 448B is separated from the main panel 412. The blank 410 comprises an aperture A11 separating the second corner panel 448B from the main panel 412.

The first end strap 450A/448*a*/440/448B/450B forms a first end wall of the carrier 490. The first end wall is separated from the main or top panel 412 by three apertures A9, A10, A11 a pair of cut lines or frangible lines 461A, 461B, an adjacent pair of the apertures being coupled by one of the cut or frangible lines 461A, 461B.

The blank comprises a second end strap 456A/454A/442/454B/456B. The second end strap 456A/454A/442/454B/456B comprises a second end panel 442. A third corner panel 454A is hingedly connected to a first end of the second end panel 442 by a hinged connection in the form of a fold line 449A. A third securing panel 456A is hingedly connected to an end of the third corner panel 456A by a hinged connection in the form of a fold line 451A. A third gusset panel 458A is hingedly interconnected between the third securing panel 456A and a second end of the first side panel 444 by fold lines 455A, 457A.

A fourth corner panel 454B is hingedly connected to a second end of the second end panel 442 by a hinged connection in the form of a fold line 449B. A fourth securing panel 456B is hingedly connected to an end of the fourth corner panel 454B by a hinged connection in the form of a fold line 451B. A fourth gusset panel 456B is hingedly interconnected between the fourth securing panel 456B and a second end of the second side panel 446 by fold lines 455B, 457B.

The second end panel 442 is separated from, or severable from, the main panel 412. The blank 410 may comprise an aperture A13 separating at least a portion of the second end panel 442 from the main panel 412. The blank 410 may comprise at least one cut line or frangible line 463A, 463B severing the second end panel 442 from the main panel 412.

The third corner panel 454A is separated from the main panel 412. The blank 410 comprises an aperture A12 separating the third corner panel 454A from the main panel 412.

The fourth corner panel 454B is separated from the main panel 412. The blank 410 comprises an aperture A14 separating the fourth corner panel 454B from the main panel 412.

The second end strap 456A/454A/442/454B/456B forms a second end wall of the carrier 490. The first end wall is separated from the main or top panel 412 by three apertures A12, A13, A14 a pair of cut lines or frangible lines 463A, 463B, an adjacent pair of the apertures being coupled by one of the cut or frangible lines 463A, 463B.

The main panel 412 comprises a plurality of apertures A1, A2, A3, A4, A5, A6, A7, A8. The apertures form part of article retention structures which include regions of the main panel 412 surrounding each of the apertures A1, A2, A3, A4, A5, A6, A7, A8. The article retention structures include a first pair of end article retention structures and a second pair of end article retention structures. The first pair of end article retention structures are struck from the main panel 412 proximate the first end strap 450A/448a/440/448B/450B. The second pair of end article retention structures are struck from the main panel 412 proximate the second end strap 456A/454A/442/454B/456B. Four intermediate article retention structures are struck from the main panel 412 and are disposed between the first pair of end article retention structures and the second pair of end article retention structures.

The end article retention structures each comprise a toothed portion and a toothless or tooth free portion.

The toothed portion comprises a pair of teeth defined in part by three cutaways C1, C2, C3. Tooth or engaging edges are defined between adjacent pairs C1/02, C2/C3 of the cutaways C1, C2, C3.

The tooth free region comprises three continuous supporting edges each being arcuate in shape. The tooth free region also comprises a pair of relief elements C4, C5 in the form of recesses or notches in the tooth free region/segment. The cutaways forming the relief elements C4, C5 may be smaller in dimension than the cutaways C1, C2, C3 defining the teeth. The relief elements C4, C5 may be smaller in a radial direction than the cutaways C1, C2, C3. The relief elements C4, C5 may define or subtend a smaller angle, having its vertex at the center of a notional circle defined by the perimeter of the apertures A1, A2, A7, A8, than an angle (also having its vertex at the center of a notional circle defined by the perimeter of the apertures A1, A2, A7, A8)

defined or subtended by the cutaways C1, C2, C3. An angle (having its vertex at the center of a notional circle defined by the perimeter of the apertures A1, A2, A7, A8) is defined between the relief elements C4, C5; the angle may be substantially 90°.

The two adjacent cutaways C1, C2, C3 of each tooth are tangentially contacted by a first notional tangential line. The first notional tangential line passes through respective tangential contacting points on respective outer ends of the two adjacent cutaways C1, C2, C3. The first notional tangential line is spaced apart from the notional circle and may lie outside the notional circle.

The relief elements C4, C5 are tangentially contacted by second notional tangential line. The notional tangential line passes through respective tangential contacting points on the two relief elements C4, C5. The notional tangential line contacts or intersects with the notional circle.

The intermediate article retention structures each comprises a perimeter consisting of a toothless region. The toothless region of each intermediate retention structure comprises four continuous supporting edges which define the perimeter of the respective aperture A3, A4, A5, A6. The toothless region may be interrupted by relief elements C7, C8, C9, C10. The relief elements C7, C8, C9, C10 may be angularly spaced equally about by the center of the apertures A3, A4, A5, A6. An angle (having its vertex at the center of a notional circle defined by the perimeter of the apertures A3, A4, A5, A6) is defined between adjacent pairs of the relief elements C7, C8, C9, C10; the angle may be substantially 90°. Notional radial lines passing through the center of the notional circle defined by the perimeter of the apertures A3, A4, A5, A6 and through the center of the relief elements C7, C8, C9, C10 may be oriented at about 45° to the fold lines 443, 445 (fold lines 443, 445 define side edges of the main panel 412).

Pairs of adjacently relief elements C7, C8, C9, C10 are tangentially contacted by a third notional tangential line. The third notional tangential line passes through respective tangential contacting points on said pair of adjacent relief elements C7, C8, C9, C10. The third notional tangential line contacts or intersects with the notional circle.

Figure 9:
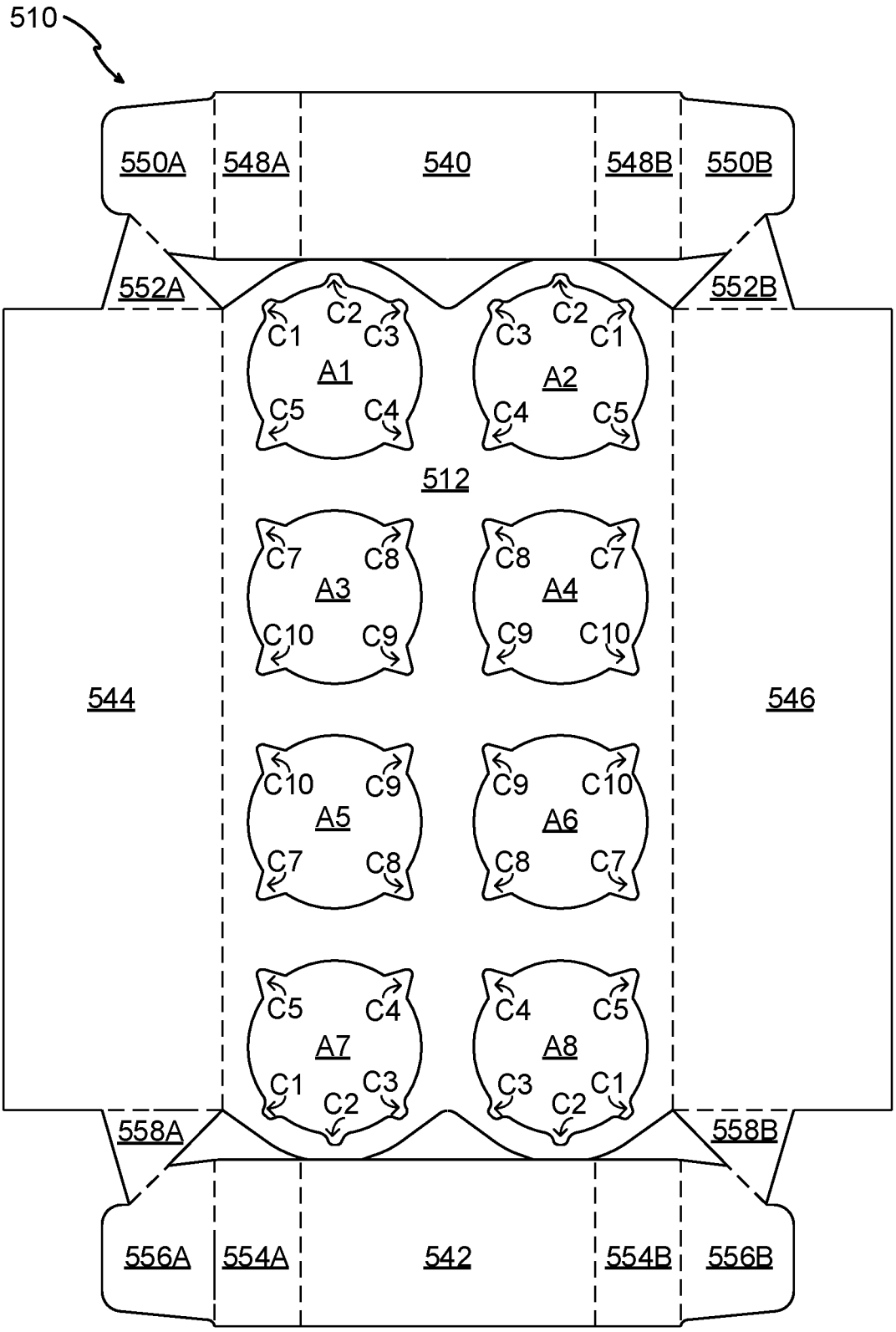
FIG. 9 is a plan view from above of a plurality of connected blanks, each blank capable of forming a carrier according to a sixth embodiment.

FIG. 9 illustrates a fifth embodiment and shows a blank 510 for forming a carrier (not shown). The carrier takes the form of a top-gripping clip or carrier. The blank 510 is substantially similar in construction to the blank 410 of FIG. 7 and comprises a main panel 512 forming a top panel of the carrier. The main panel 512 comprises article retention structure substantially similar to those of the blank 410 shown in FIG. 7 albeit the relief elements C4, C5, C7, C8, C9, C10 are arranged to be larger than the cutaways C1, C2, C3 defining the toothed region of the article retention structure. The relief elements C4, C5, C7, C8, C9, C10 are substantially "V" shaped.

The cutaways C1, C2, C3 may be smaller in dimension than the relief elements C4, C5, C7, C8, C9, C10. The cutaways C1, C2, C3 may be smaller in a radial direction than the relief elements C4, C5, C7, C8, C9, C10. The cutaways 01,02, C3 may define or subtend a smaller angle (having its vertex at the center of a notional circle defined by the perimeter of the apertures A1, A2, A3, A4, A5, A6, A7, A8) than an angle (also having its vertex at the center of a notional circle defined by the perimeter of the apertures A1, A2, A3, A4, A5, A6, A7, A8) defined or subtended by the relief elements C4, C5, C7, C8, C9, C10.

Figure 10:
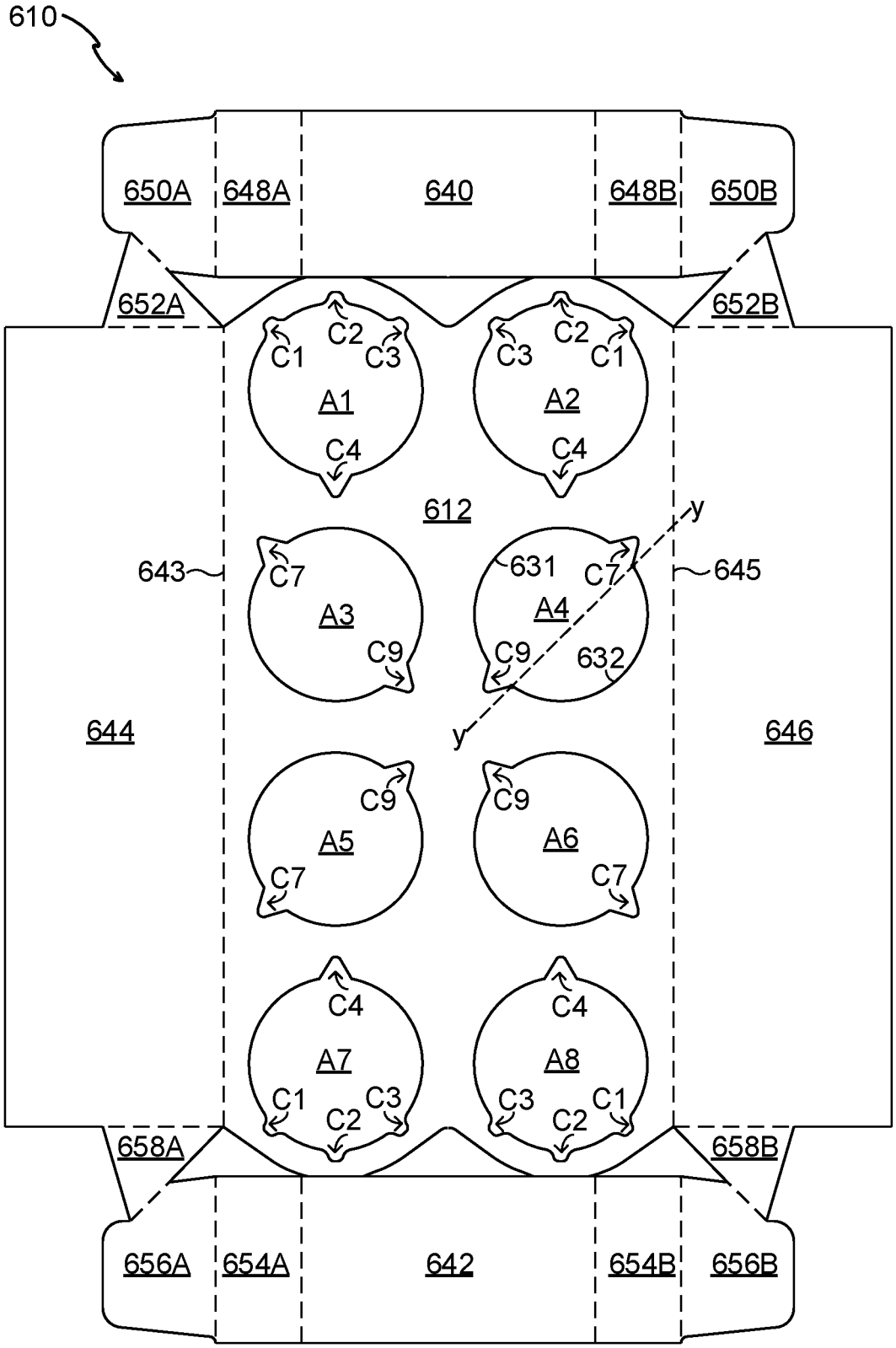
FIG. 10 is a plan view from above of a plurality of connected blanks, each blank capable of forming a carrier according to a seventh embodiment.

FIG. 10 illustrates a sixth embodiment and shows a blank 610 for forming a carrier (not shown). The carrier takes the form of a top-gripping clip or carrier. The blank 610 is substantially similar in construction to the blank 410 of FIG. 7 and comprises a main panel 612 forming a top panel of the carrier. The main panel 612 comprises article retention structure substantially similar to those of the blank 410 shown in FIG. 7. The relief elements C5, C7, C10 have been omitted. The relief elements C4, C7, C9, are arranged to be larger than the cutaways C1, C2, C3 defining the toothed region of the endmost article retention structures. The relief elements C4, C7, C9 are substantially "V" shaped.

The location of the relief element C4 of the endmost article retention structures has been changed. A notional radial line passing through the center of a notional circle defined by the perimeter of the apertures A1, A2, A7, A8 and through the center of the relief element C4 is oriented substantially parallel to the side edges of the main panel 612 (parallel to the fold lines 643, 645).

The relief elements C7, C9 define in part a pair of supporting edges 631, 632 of the intermediate article retention structures which relief elements C7, C9 are tangentially contacted by a notional tangential line y-y. The notional tangential line y-y passes through respective tangential contacting points on the two relief elements C7, C9 of the supporting edges 631, 632. The notional tangential line y-y contacts or intersects with the notional circle NC. The relief element C4 and each of the cutaways C1, C3 are of the endmost article retention structures are similarly arranged.

Figure 11:
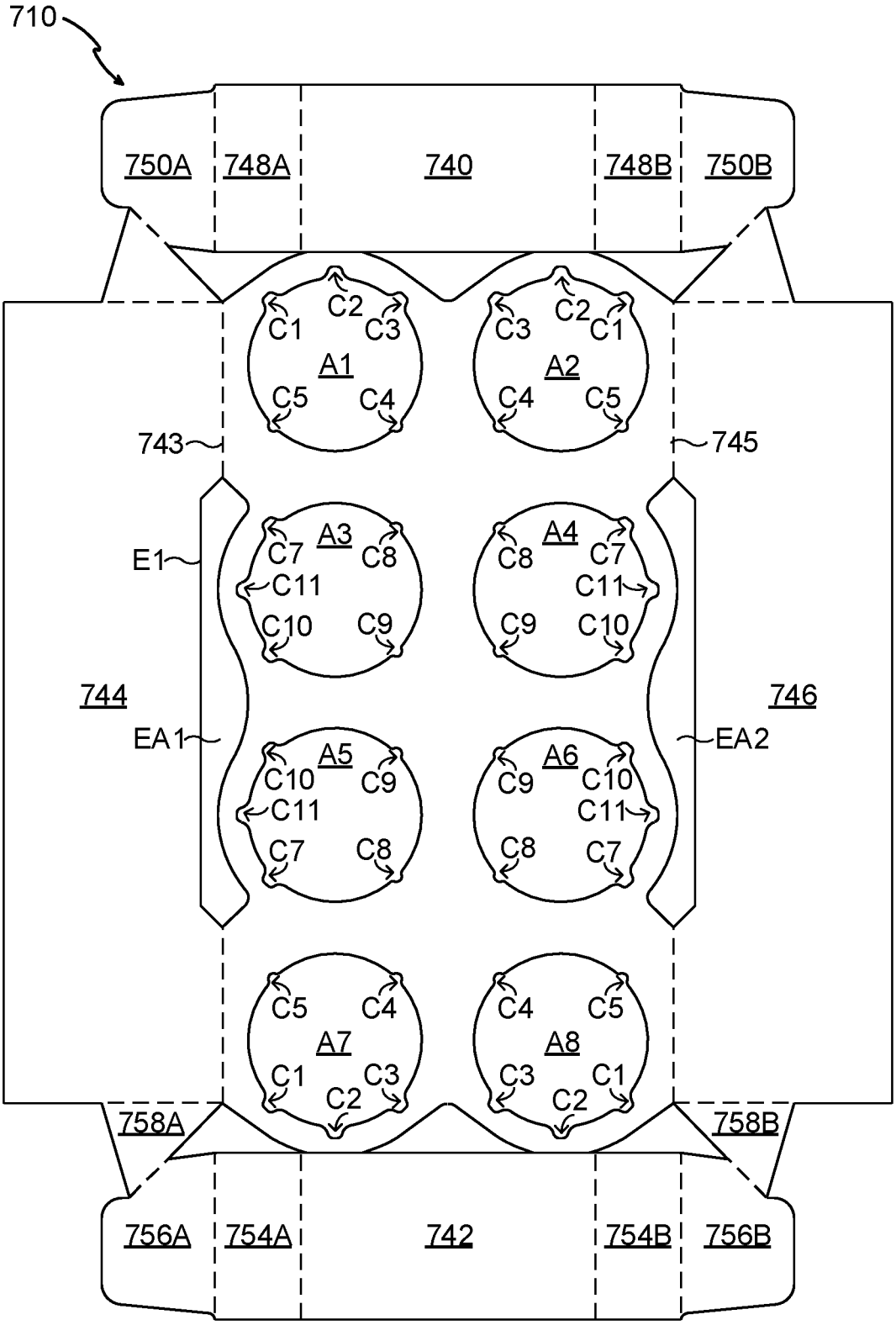
FIG. 11 is a plan view from above of a plurality of connected blanks, each blank capable of forming a carrier according to an eighth embodiment.

FIG. 11 illustrates a seventh embodiment and shows a blank 710 for forming a carrier (not shown). The carrier takes the form of a top-gripping clip or carrier. The blank 710 is substantially similar in construction to the blank 410 of FIG. 7 and comprises a main panel 712 forming a top panel of the carrier. The main panel 712 comprises article retention structure substantially similar to those of the blank 410 shown in FIG. 7.

The blank 710 comprises at least one separation feature EA1, EA2. The blank 710 comprises two separation feature EA1, EA2. The separation feature EA1, EA2 takes the form of an elongate aperture which separates a portion of the main panel 712 from the first or second side panels (also referred to herein as facing panels). The aperture comprises a first side edge defined in the facing panel 744, 746 which is substantially linear in shape. The aperture comprises a second side edge defined, at least in part, in the main panel 712 which is curvilinear in shape and may be undulating in shape. At least a portion of the curved edge of the aperture may follow a portion of the notional circle defined by the perimeter of the apertures A3, A4, A5, A6 of the intermediate article retention structures so as to define a toothed region therebetween.

The separation feature EA1, EA2 interrupts the hinged connection 743, 745 between the main panel 712 and the respective one of the first or second side panels 744, 746.

In some embodiments the toothed region surrounding the intermediate article retention structures may be provided in part by regions which would otherwise form the facing panel 744, 746 in the absence of the separation feature EA1, EA2. In this way the edge of the top panel 712 proximate the cutaways C7, C10, C11 (which define in part the teeth of the intermediate article retention structures) can be spaced further apart from the cutaways C7, C10, C11 so as to reduce the likelihood of tears propagating therebetween.

It will be appreciated that the intermediate article retention structures are structured substantially the same as the endmost article retention structures albeit the intermediate article retention structures have been oriented substantially perpendicular with respect to the orientation of the endmost article retention structures.

The toothed region of the endmost article retention structures substantially faces the respective end edges of the main panel 712.

The toothed region of the intermediate article retention structures substantially faces the respective side edges of the main panel 712.

In alternative embodiments the separation feature EA1, EA2 may be formed from a cut or severable line, the cut line may be formed in the main panel 712, the facing panel 744, 746 or in both the main panel 712 and the facing panel 744, 746. In other embodiments the separation feature EA1, EA2 may be formed form a combination of apertures and cut or severable lines interrupting the hinged connection between the main panel 712 and the facing panel 744, 746.

Figure 12:
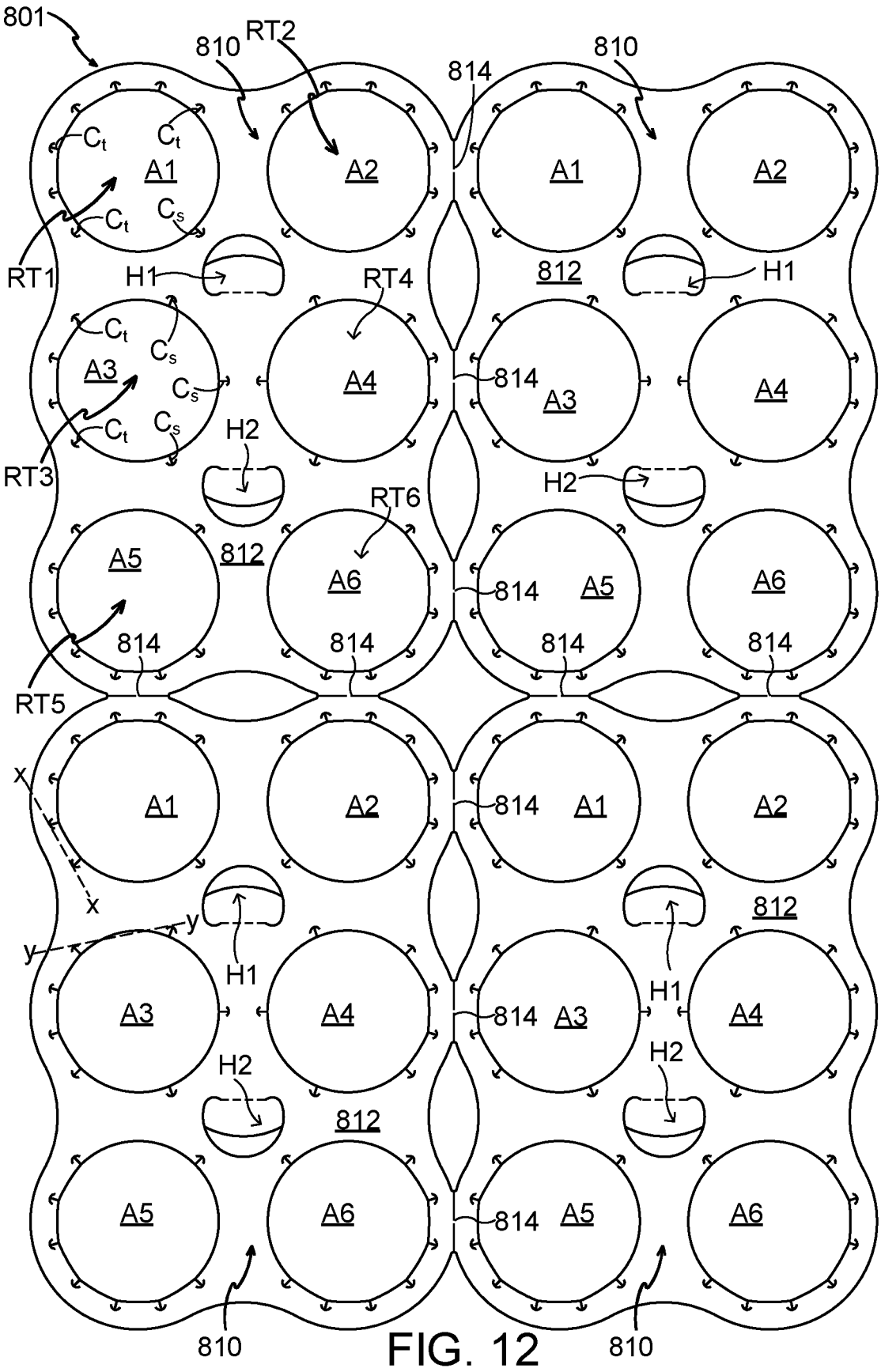
FIG. 12 is a plan view from above of a plurality of connected blanks, each blank capable of forming a carrier according to a ninth embodiment.

FIG. 12 illustrates a ninth embodiment and shows a plurality of connected blanks referred to generally by reference sign 801 specifically there are four blanks 810, arranged in a 2×2 matrix or array. Each blank 810 comprises a main panel 812 for forming a top wall or engaging panel of a carrier (not shown). Each blank 810 is connected to two adjacent blanks 810, by frangible connections 814.

Each of the blanks 810 are substantially similar in structure to the blanks 210A, 210B, 210C, 210D of FIG. 5 albeit the relief elements $C_t$, $C_s$ have been constructed from slits and/or cuts. The relief elements $C_t$, $C_s$ comprise a radial cut line or slit extending from the perimeter of top-receiving openings A1, A2, A3, A4, A5, A6. Each of the radial cut lines terminated with or intersects with a non-linear or curvilinear cut line or tear stopper cut. The non-linear cut line or tear stopper cut may be substantially arcuate.

In the embodiment of FIG. 12, endmost article retention structures RT1, RT2, RT5, RT6 each comprises six teeth defined, at least in part, by seven relief elements $C_t$. The endmost article retention structures RT1, RT2, RT5, RT6 each comprises a toothless region/segment comprising two continuous supporting edges and one relief element $C_s$. The toothed segment of each end most retention structure occupies substantially 180° of the perimeter of the respective endmost aperture A1, A2, A5, A6. The toothless segment of each endmost retention structure occupies substantially 180° of the perimeter of the respective aperture A1, A2, A5, A6.

In the embodiment of FIG. 12, medial article retention structures RT3, RT4 each comprises three teeth defined, at least in part, by four relief elements $C_t$. The medial article retention structures RT3, RT4 each comprise a toothless region which comprises four continuous supporting edges and three relief elements $C_s$. The toothed segment of each medial retention structure occupies substantially 90° of the perimeter of the respective apertures A3, A4. The toothless segment of each medial retention structure occupies substantially 270° of the perimeter of the respective apertures A3, A4.

Referring now to FIGS. 13A to 13D and 14, there is shown a further embodiment of the present disclosure. In the tenth illustrated embodiment like numerals have, where possible, been used to denote like parts, albeit with the addition of the prefix "900 to indicate that these features belong to the tenth embodiment. The additional embodiments share many common features with the first embodiment and therefore only the differences from the embodiment illustrated in FIGS. 1 to 3 will be described in detail.

Figure 13A:
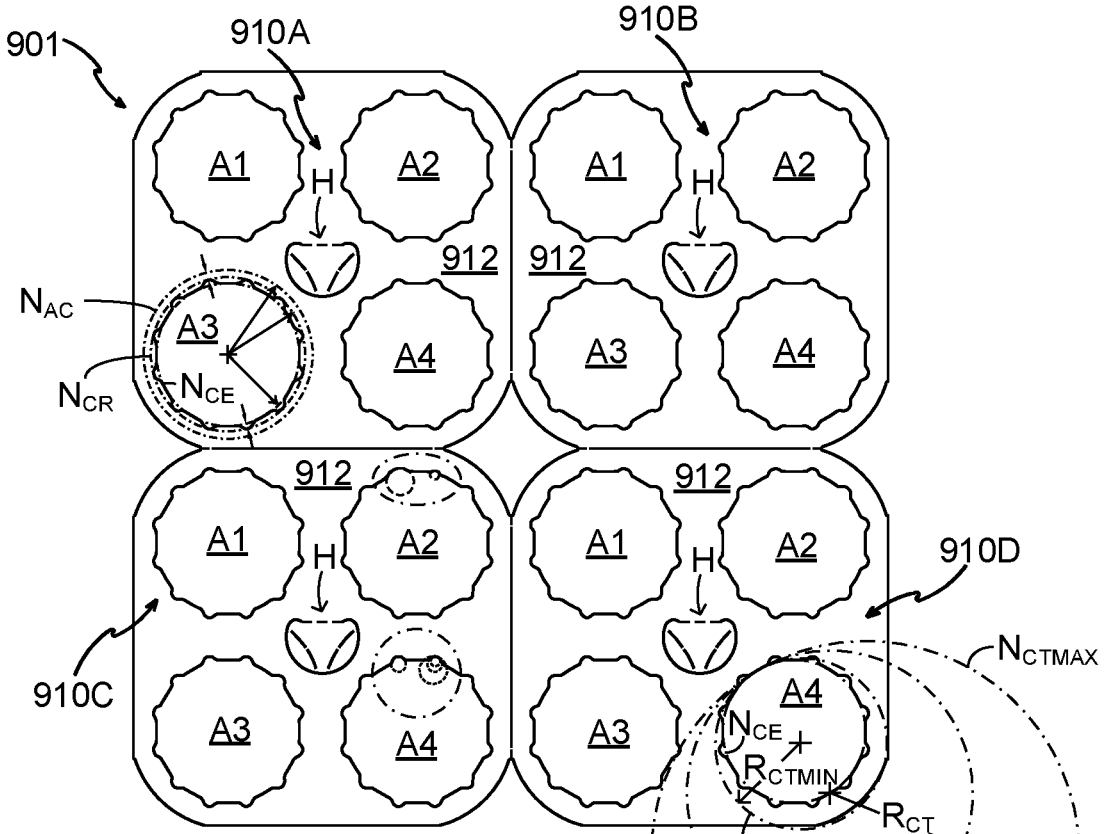
FIG. 13A is a plan view from above of a plurality of connected blanks, each blank capable of forming a carrier according to a tenth embodiment.

FIG. 13A illustrates a plurality of connected blanks referred to generally by reference sign 901, specifically there are four blanks 910A, 910B, 910C, 910D arranged in a 2×2 matrix or array. Each blank 910A, 910B, 910C, 910D comprises a main panel 912 for forming a top wall or engaging panel of a carrier 990 (see FIG. 14). Each blank 910A, 910B, 910C, 910D is connected to at least two adjacent blanks 910A, 910B, 910C, 910D by frangible connections 14.

The main panel 912 includes at least one article retention structure. The main panel 912 comprises a plurality of article retention structures, specifically four article retention structures arranged in 2×2 matrix or array. Each of the article retention structures comprise an aperture A1, A2, A3, A4.

Each of the article retention structures are substantially similar in construction.

Each article retention structure comprises an article receiving opening defined in part by a respective one of the apertures A1, A2, A3, A4.

Each of the apertures A1, A2, A3, A4 comprises a perimeter which may approximate, or define, a notional circle NCE. The notional circle NCE comprises a radius RCE.

Figure 13B:
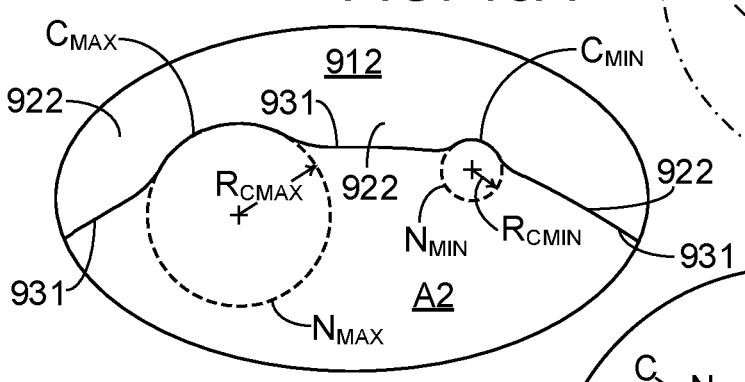
FIG. 13B is an enlarged plan view of a portion of one of the blanks of FIG. 13A showing an article retention structure.
Figure 13C:
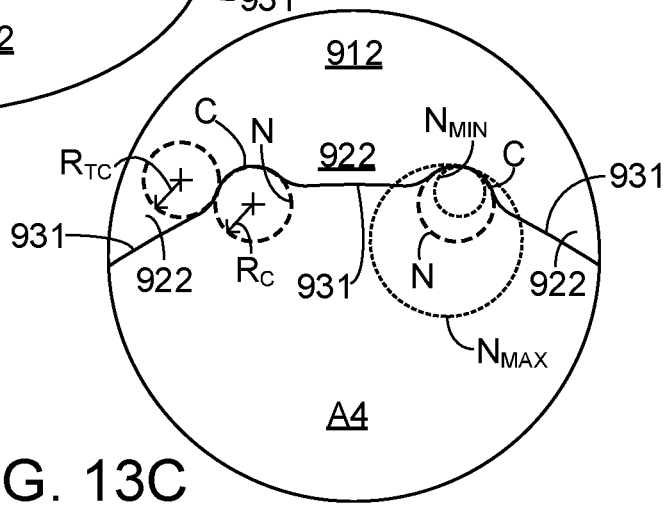
FIG. 13C is an enlarged plan view of another portion of one of the blanks of FIG. 13A showing optional article retention structure arrangements.
Figure 13D:
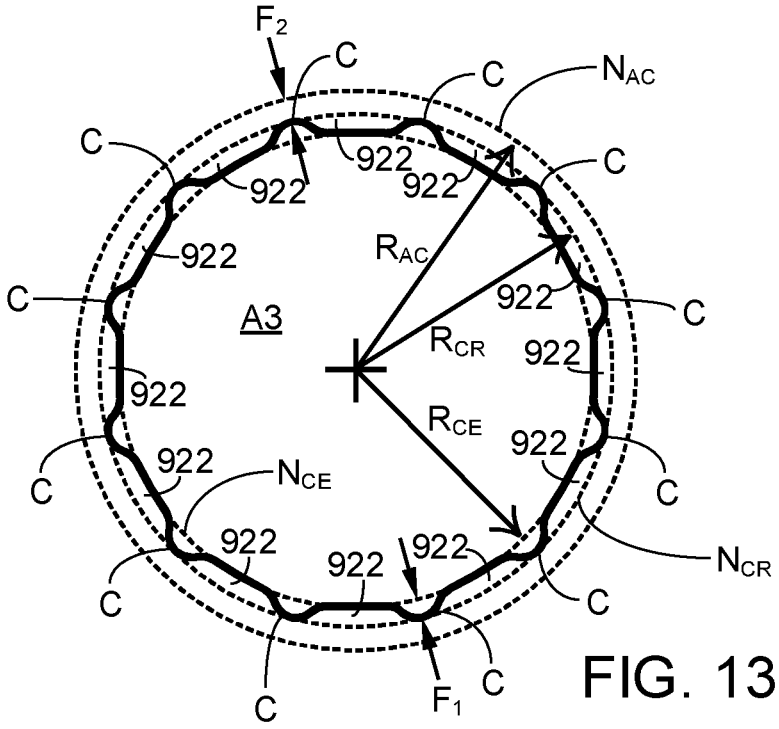
FIG. 13D is an enlarged plan view of an article receiving aperture of the blanks of FIG. 13A.
Figure 14:
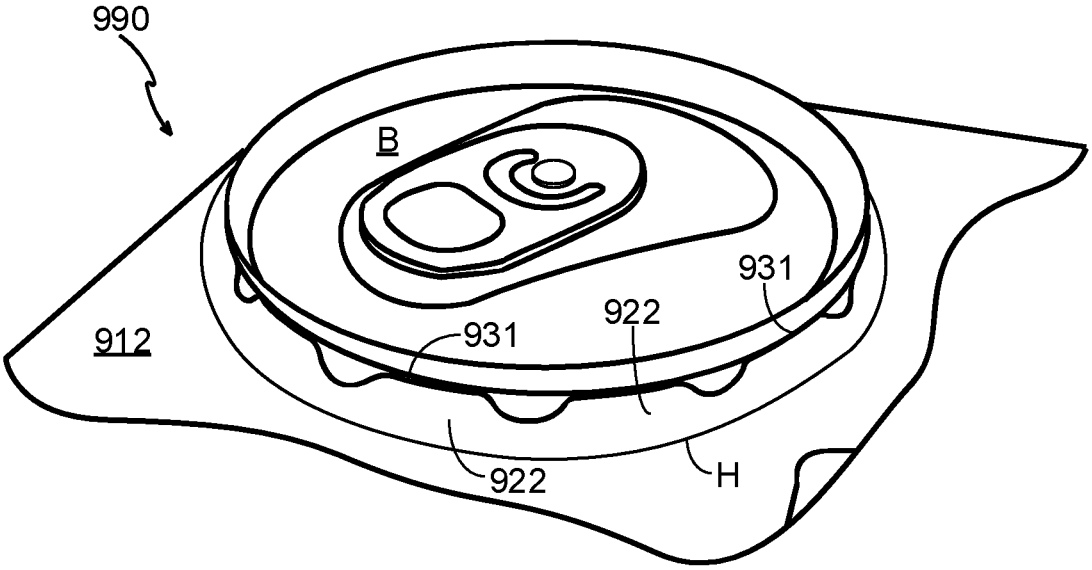
FIG. 14 is a perspective view from above of a portion of a carrier formed from one of the blanks of FIG. 13A illustrating deformation of the carrier about an article.

Each article retention structure comprises a plurality of teeth 922, see FIGS. 13B, 13C and 13D disposed about the circumference or perimeter of their respective aperture A1, A2, A3, A4.

The teeth 922 are formed in the main panel 912 about the apertures A1, A2, A3, A4.

Each tooth 922 comprises an engaging or tooth edge 931. Each tooth edge 931 is arcuate. The tooth edges 931 are defined by an arc or portion of a circle $N_{CT}$. In some embodiments the tooth edges 931 may defined by an arc or portion of a circle $N_{CTMIN}$, the radius RCTMIN of the circle $N_{CTMIN}$ being less than the radius $R_{CT}$ of the circle $N_{CT}$. In other embodiments the tooth edges 931 may defined by an arc or portion of a circle $N_{CTMAX}$, the radius $R_{CTMAX}$ of the circle $N_{CTMAX}$ being greater than the radius of the circle $N_{CT}$. In one example the circle $N_{CT}$ may have a radius of 50 mm (63/32"). The radius of the circle may be in the range 30 mm (1.181") to 75 mm (189/64").

In the illustrated embodiment the tooth edges 931 are defined by a portion of the circle $N_{CT}$, the circle $N_{CT}$ comprises a radius $R_{CT}$ which is greater than the radius $R_{CE}$ of the notional circle $N_{CE}$ of the apertures A1, A2, A3, A4.

The main panel 12 comprises cutaways C in the form of recesses or notches. The cutaways C are substantially "U" shaped, the cutaways C each define a portion of a notional circle N see FIG. 13C. The notional circle N comprises a radius $R_C$.

The cutaways C extend radially outward from the notional circle $N_{CE}$ defined by the teeth 922.

The teeth 922 are each defined, at least in part, by a pair of cutaways C. The cutaways C form relief elements extending radially away from the center of the notional circle $N_{CE}$.

In some embodiments the main panel 912 comprises cutaways $C_{MAX}$ each defining a portion of a notional circle $N_{MAX}$ see FIG. 13B. The notional circle $N_{MAX}$ comprises a radius $R_{CMAX}$. The radius $R_{CMAX}$ is greater than the radius $R_C$.

In some embodiments the main panel 912 comprises cutaways $C_{MIN}$ each defining a portion of a notional circle $N_{MIN}$ see FIG. 13B. The notional circle $N_{MIN}$ comprises a radius $R_{CMIN}$. The radius $R_{CMIN}$ is less than the radius $R_C$. FIG. 13C shows a comparison of the notional circles $N_{MIN}$, N, $N_{MAX}$.

In one embodiment the cutaways C are defined by a radius $R_C$=2.38 mm (3/32"), the radius $R_C$ may be in the range 1.59 mm (1/16") to 4.76 mm (3/16"), that is to say $R_{CMIN}$=1.59 mm (1/16") and $R_{CMAX}$=4.76 mm (3/16").

It will be appreciated that the radius of curvature $R_{CT}$ of the engaging edges of the teeth 922 is substantially greater than the radius of curvature $R_C$ of the cutaways C. The ratio of the radius of curvature $R_C$ of the cutaways C to the radius of curvature $R_{CT}$ of the engaging edges of the teeth 922, ($R_C/R_{CT}$), may be in the range 0.02 to 0.16, ($0.02<R_C/R_{CT}<0.16$).

The outermost portions of the cutaways C define a notional circle $N_{CR}$, the notional circle NCR is concentric with notional circle $N_{CE}$ defined by the apertures A1, A2, A3, A4. The notional circle $N_{CR}$ is comprises a radius $R_{CR}$ which is greater than the radius $R_{CE}$ of the notional circle $N_{CE}$ defined by the apertures A1, A2, A3, A4. A gap, space or distance F1 is defined radially therebetween.

Optionally, the notional circle $N_{CR}$ defined by the cutaways C is arranged to be substantially equal to, or slightly greater than a circle defined by a rim, chime or uppermost end of the article B to be received therein.

FIG. 13D shows a notional circle $N_{AC}$, also referred to herein as application circle, it has been found that the main panel 912 deforms proximate to the application circle $N_{AC}$ when an article B is engaged by the main panel 912, a crease line H may be formed in the main panel 912 outside or below the outermost, lowermost, edges of the cutaways C.

The present disclosure provides a carrier of the top engaging type having improved article retention structures or article top engaging devices.

The carrier may be provided by a blank comprising an engaging aperture having at least one engaging edge. The engaging edge may be defined by a tooth or by non-tooth engaging element. The engaging edge may be a tooth edge or a toothless engaging edge. The engaging edge is defined between a pair of adjacent relief elements or notches. The engaging edge is curved. The bottom or outer edge of each relief element, recess or notch is curved. The radius of curvature $R_C$ of each relief element or notch is considerably less than the radius of curvature $R_{CT}$ of the engaging edge.

The carrier may be provided by a blank comprising an engaging aperture having at least two engaging elements. The engaging elements comprise teeth or non-tooth engaging elements or combination thereof. The at least two engaging elements are spaced apart from each other by a relief element, recess or notch. The engaging edge of each engaging element is curved. The bottom or outer edge of each relief element, recess or notch is curved. The radius of curvature $R_C$ of each relief element, recess or notch is considerably less than the radius of curvature $R_{CT}$) of the engaging edge.

The radius of curvature $R_{CT}$ of the engaging edge may be greater than a half of the upper can chime diameter.

The radius of curvature $R_C$ of each relief element may be about 2.38 mm (3/32") for a US standard can having an end or lid diameter of about 54 mm (34/16").

The radius of curvature $R_{CT}$ of the engaging edge may be about 50 mm (63/32") for a US standard can having an end or lid diameter of about 54 mm (34/16").

In some embodiments, the corner of each tooth or non-tooth element may be rounded. The radius of curvature $R_{TC}$ of the rounded corner may be generally equal to the radius of curvature $R_C$ of the relief element.

The carrier may be provided by a blank comprising an engaging aperture having at least one notch along its perimeter. The engaging aperture comprises a notional circle concentric with the engaging aperture and being in tangential contact with the at least one notch. The notional circle has a diameter ($2xR_{CR}$) which is equal to or greater than the diameter of the upper can chime and less than the diameter of the can body. The diameter of the engaging aperture is less than the upper can chime such that when the upper can chime is received in the engaging aperture, a region of blank peripheral to the engaging aperture is displaced upwardly with respect to the remainder of the blank to bring the perimeter of the engaging aperture into engagement with the underside of the upper can chime.

The notional circle diameter ($2xR_{CR}$) may be generally equal to the diameter of the upper can chime.

The article top engaging device comprises an engaging panel 12; 112; 212; 312; 412; 512; 612; 712; 812 having at least one top-receiving opening A1, A2, A3, A4, A5, A6, A7, A8 defined by a perimeter which defines a notional circle NC. The perimeter is interrupted by at least three relief elements C1, C2, C3, C4, C5, C6, C7, C8, C9, C10, C11, $C_t$, $C_s$ each extending radially away from the center of the notional circle NC. The perimeter comprises a toothed segment S1 and a toothless segment S2. The toothed segment S1 comprises at least two tooth edges 31, 32, 33, 34, 35, 36; 231, 232, 233, 234, 235, 236 for bearing a substantially vertical load. Each of the at least two tooth edges is defined between two adjacent ones of the at least three relief elements C1, C2, C3, C4, C5, C6, C7, C8, C9, C10, C11, $C_t$, $C_s$. The two adjacent relief elements C1, C2, C3, C4, C5, C6, C7, C8, C9, C10, C11, $C_t$, $C_s$ of each tooth edge is tangentially contacted by a first notional tangential line x-x which passes through respective tangential contacting points TP, TP on respective outer ends of the two adjacent relief elements C1, C2, C3, C4, C5, C6, C7, C8, C9, C10, C11, $C_t$, $C_s$. The first notional tangential line x-x is spaced apart from the notional circle NC. The toothless segment S2 comprises at least one continuous supporting edge 37; 237A, 237B, 237C for bearing a substantially vertical load. The at least one continuous supporting edge 37; 237A, 237B, 237C is defined between two adjacent ones of the at least three relief elements C1, C2, C3, C4, C5, C6, C7, C8, C9, C10, C11, $C_t$, $C_s$. The two adjacent relief elements C1, C2, C3, C4, C5, C6, C7, C8, C9, C10, C11, $C_t$, $C_s$ of the at least one continuous supporting edge 37; 237A, 237B, 237C is tangentially contacted by a second notional tangential line y-y which passes through respective tangential contacting points TP, TP on the two adjacent relief elements C1, C2, C3, C4, C5, C6, C7, C8, C9, C10, C11, $C_t$, $C_s$ of the at least one continuous supporting edge 37; 237A, 237B, 237C. The second notional tangential line y-y contacts or intersects with the notional circle NC.

The present disclosure further provides a carrier having an article engaging device comprising an engaging panel 212; 412; 512; 612; 712; 812 having at least one top-receiving opening A1, A2, A3, A4, A5, A6, A7, A8 defined by a perimeter which defines a notional circle NC. The perimeter is interrupted by at least two relief elements C1, C2, C3, C4, C5, C7, C8, C9, C10, C11, $C_t$, $C_s$ each extending radially away from the center of the notional circle NC. The perimeter comprises at least two continuous supporting edges 237A, 237B, 237C; 631, 632 for bearing a substantially vertical load. Each of the at least two continuous supporting edges is defined between two adjacent ones of the at least two relief elements C1, C2, C3, C4, C5, C7, C8, C9, C10, C11, $C_t$, $C_s$. The two adjacent relief elements C1, C2, C3, C4, C5, C7, C8, C9, C10, C11, $C_t$, $C_s$ of the continuous supporting edges 237A, 237B, 237C; 631, 632 are tangentially contacted by a notional tangential line y-y which passes through respective tangential contacting points TP, TP on the two adjacent relief elements C1, C2, C3, C4, C5, C7, C8, C9, C10, C11, $C_t$, $C_s$ of each continuous supporting edge 237A, 237B, 237C; 631, 632. The notional tangential line y-y contacts or intersects with the notional circle NC.

An article top engaging device is disclosed which comprises an engaging panel 712 and a facing panel 744, 746 hingedly connected directly to the engaging panel 712 along a fold line 743, 745. The engaging panel 712 has at least one top-receiving opening A1, A2, A3, A4, A5, A6, A7, A8 adjacent to the facing panel 744, 746. The opening 744, 746 is defined by a perimeter which defines a notional circle NC. The perimeter is interrupted by at least three relief elements C1, C2, C3, C4, C5, C7, C8, C9, C10, C11 each extending radially away from the center of the notional circle NC generally toward the facing panel 744, 746 such that the perimeter comprises at least two engaging teeth for engaging a top of an article. The device further comprises a separation feature EA1, EA2 disposed between the facing panel 744, 746 and the teeth of the at least one opening A1, A2, A3, A4, A5, A6, A7, A8.

The relief elements may include any one of a notch, a recess, a slit, a cut, or a combination of a cut and a tear stopper at the outer end of the cut. The relief notch or notches for defining or partially defining a continuous supporting edge may be of a different width and/or of a different radial length from those for defining a tooth edge.

The angular width/length of any one of the relief elements C1, C2, C3, C4, C5, C6, C7, C8, C9, C10, C11 of an opening A1, A2, A3, A4, A5, A6, A7, A8 is substantially less than the angular width/length of any one of the supporting edges 37; 237A, 237B, 237C; 631, 632 of the same opening A1, A2, A3, A4, A5, A6, A7, A8. Optionally angular width/length of any one of the relief elements C1, C2, C3, C4, C5, C6, C7, C8, C9, C10, C11 of an opening is less than the angular width/length of any one of the tooth edges of the same opening.

It will be recognized that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, embossed lines, debossed lines, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A blank for forming an article carrier configured to engage an article having a diameter, the blank comprising an engaging aperture having an engaging edge, wherein the engaging edge is defined between a pair of adjacent notches and the engaging edge is curved, the bottom of each notch is curved, a radius of curvature (RC) of each notch is considerably less than a radius of curvature (RCT) of the engaging edge, wherein the radius of curvature (RCT) of the engaging edge is greater than half the diameter of the article that the article carrier formed from the blank is configured to engage.

2. A blank according to claim 1 wherein the engaging edge is defined by at least one of a tooth, a non-tooth engaging element, and a toothless engaging edge.

3. A blank according to claim 1 wherein the engaging aperture comprises at least two engaging elements each having the engaging edge, wherein the at least two engaging elements are spaced apart from each other by one of the pair of notches and the engaging edge of each engaging element is curved, wherein the radius of curvature (RC) of each notch is considerably less than the radius of curvature (RCT) of the engaging edge, and wherein the at least two engaging elements comprise at least one of the following: (i) at least two teeth, (ii) at least two non-tooth engaging elements, and (iii) at least one tooth and at least one non-tooth engaging element.

4. A blank according to claim 1 wherein the radius of curvature (RCT) of the engaging edge is greater than or equal to a radius of curvature (RCE) of a notional circle defined by the perimeter of the engaging aperture.

5. A blank according to claim 1 wherein the radius of curvature (RC) of each notch is in the range 1.59 mm (1/16") to 4.76 mm (3/16"), and the radius of curvature (RCT) of the engaging edge is in the range 30 mm (1.181") to 75 mm (189/64").

6. A blank according to claim 1 wherein the ratio of the radius of curvature (RC) of the notches to the radius of curvature (RCT) of the engaging edge (RC/RCT) is in the range 0.02 to 0.16, ($0.02<R_C/R_CT<0.16$).

7. An article top engaging device for an article carrier comprising an engaging panel having at least one top-receiving opening defined by a perimeter which defines a notional circle, the perimeter being interrupted by at least two relief elements each extending radially away from the center of the notional circle, the perimeter comprising a toothed segment and a toothless segment, the toothed segment comprising at least one tooth edge for bearing a substantially vertical load, at least one tooth edge being defined between two adjacent ones of the at least two relief elements, the at least one tooth edge subtending a first angle having a vertex at a center of the notional circle, the toothless segment comprising at least one continuous supporting edge for bearing a substantially vertical load, the at least one continuous supporting edge being defined between two adjacent ones of the at least two relief elements, the at least one continuous supporting edge being arcuate in shape and subtending a second angle having a vertex at the center of the notional circle, the second angle being substantially greater than the first angle.

8. An article top engaging device according to claim 7 wherein the two adjacent relief elements of the at least one tooth edge are tangentially contacted by a first notional tangential line which passes through respective tangential contacting points on respective outer ends of the two adjacent relief elements, the first notional tangential line being spaced apart from the notional circle.

9. An article top engaging device according to claim 7 wherein the two adjacent relief elements of the at least one continuous supporting edge are tangentially contacted by a second notional tangential line which passes through respective tangential contacting points on the two adjacent relief elements of the at least one continuous supporting edge, the second notional tangential line contacting or intersecting with the notional circle.

10. An article top engaging device according to claim 9 wherein the two adjacent relief elements of the at least one tooth edge are tangentially contacted by a first notional tangential line which passes through respective tangential contacting points on respective outer ends of the two adjacent relief elements of the at least one tooth edge, the first notional tangential line being spaced apart from the notional circle.

11. An article top engaging device according to claim 7 wherein a first relief element defining at least in part the at least one continuous supporting edge is of a different dimension from a second relief element defining at least in part the at least one tooth edge.

12. An article top engaging device according to claim 7 wherein each relief element comprises a first length and the at least one continuous supporting edge defines a second length, and the first length is substantially less than the second length.

13. An article top engaging device according to claim 12 wherein the first length is defined by a first arc of the notional circle defined between opposed outer edges of the each relief element, and the second length is defined by a second arc of the notional circle defined between adjacent edges of the two adjacent ones of the at least two relief elements which define the at least one supporting edge.

14. An article top engaging device according to claim 12 wherein the at least one tooth edge comprises third length and the third length is substantially less than the second length.

15. An article top engaging device according to claim 14 wherein the second length is defined by a second arc of the notional circle defined between adjacent edges of the two adjacent ones of the at least two relief elements which define the at least one supporting edge and the third length is defined by a third arc of the notional circle defined between adjacent edges of the two adjacent ones of the at least two relief elements which define the at least one tooth edge.

16. An article top engaging device according to claim 14 wherein the first length is defined by an arc of the notional circle defined by opposed outer edges of the each relief element, and the third length is defined by the length of a chord of the notional circle which is defined between adjacent edges of the two adjacent ones of the at least two relief elements which define the at least one tooth edge.

17. An article top engaging device according to claim 7 wherein the toothless segment comprises at least one of: a deformation line at least partially surrounding the perimeter of the at least one top-receiving opening, and a fold line at least partially surrounding the perimeter of the at least one top-receiving opening.

18. A blank for forming an article carrier, the blank comprising a main panel including at least one top engaging device having at least one top-receiving opening defined by a perimeter which defines a notional circle, the perimeter being interrupted by at least two relief elements each extending radially away from the center of the notional circle, the perimeter comprising a toothed segment and a toothless segment, the toothed segment comprising at least one tooth edge for bearing a substantially vertical load, the at least one tooth edge being defined between two adjacent ones of the at least two relief elements, the at least one tooth edge subtending a first angle having a vertex at a center of the notional circle, the toothless segment comprising at least one continuous supporting edge for bearing a substantially vertical load, the at least one continuous supporting edge being defined between two adjacent ones of the at least two relief elements, the at least one continuous supporting edge being arcuate in shape and subtending a second angle having a vertex at the center of the notional circle, the second angle being substantially greater than the first angle.

19. A blank according to claim 18 wherein the two adjacent relief elements of the at least one continuous supporting edge are tangentially contacted by a second notional tangential line which passes through respective tangential contacting points on the two adjacent relief elements of the at least one continuous supporting edge, the second notional tangential line contacting or intersecting with the notional circle.

20. A blank according to claim 19 wherein the two adjacent relief elements of the at least one tooth edge are tangentially contacted by a first notional tangential line which passes through respective tangential contacting points on respective outer ends of the two adjacent relief elements of the at least one tooth edge, the first notional tangential line being spaced apart from the notional circle.

* * * * *